United States Patent [19]

Shah et al.

[11] 4,353,452

[45] Oct. 12, 1982

[54] COIN-HANDLING DEVICE

[75] Inventors: Hasmukh R. Shah; Michael S. Ross, both of Hot Springs, Ark.

[73] Assignee: U.M.C. Industries, Inc., Stamford, Conn.

[21] Appl. No.: 137,434

[22] Filed: Apr. 4, 1980

[51] Int. Cl.[3] ..... G07F 3/02

[52] U.S. Cl. ..... 194/100 A; 73/163

[58] Field of Search ..... 194/97 R, 99, 100 R, 194/100 A; 73/163; 324/234, 236, 228, 233, 239, 243

[56] References Cited

U.S. PATENT DOCUMENTS

| | | | |
|---|---|---|---|
| 3,059,749 | 10/1962 | Zinke | 324/234 X |
| 3,152,677 | 10/1964 | Phillips | 194/100 R |
| 3,373,856 | 3/1968 | Kusters et al. | 194/100 R |
| 3,481,443 | 12/1969 | Meloni | 194/100 R |
| 3,796,295 | 3/1974 | Montolivo et al. | 194/100 A |
| 3,870,137 | 3/1975 | Fougere | 194/100 A |
| 3,918,563 | 11/1975 | Schwippert et al. | 194/100 A |
| 4,124,111 | 11/1978 | Hayashi | 194/100 A X |

*Primary Examiner*—Robert J. Spar
*Assistant Examiner*—Edward M. Wacyra
*Attorney, Agent, or Firm*—Rogers, Eilers & Howell

[57] ABSTRACT

A detecting magnetic coil is mounted adjacent the authenticity-determining magnetic coil of an electronic slug rejector to distinguish between authentic coins and any copper slugs which might cause the authenticity-determining coil to produce an output which closely simulates the output which that authenticity-determining coil produces in response to authentic coins. The signal from that detecting coil is used to control the accept/reject gate of that electronic slug rejector; and it will effect movement of that gate to "accept" position in the event it detects a non-cupreous object but it will not effect such movement of that gate in the event it detects a copper slug.

17 Claims, 16 Drawing Figures

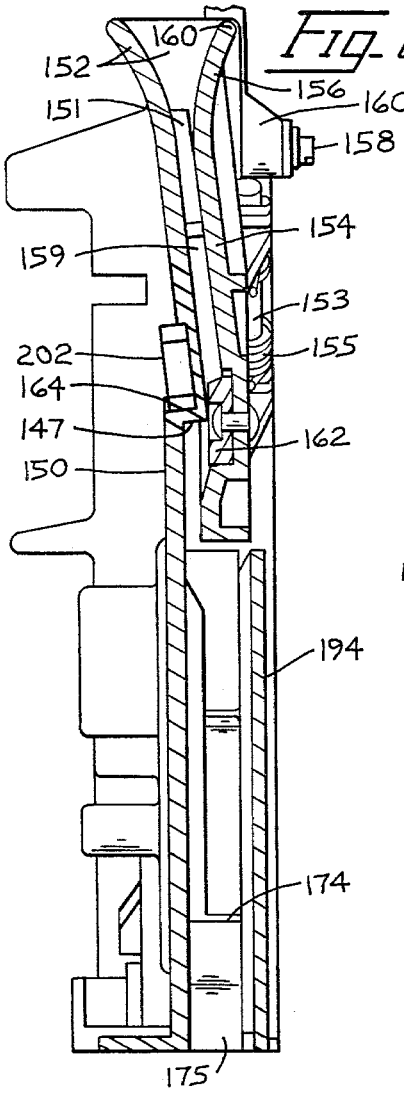
Fig. 6.
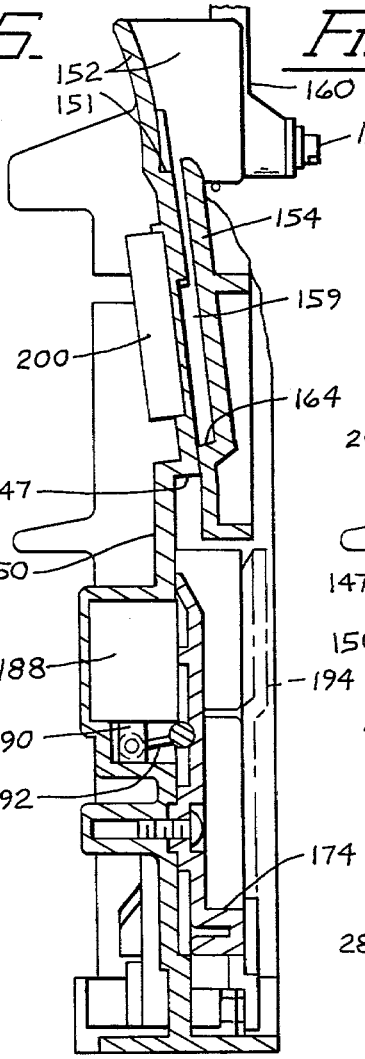
Fig. 7.
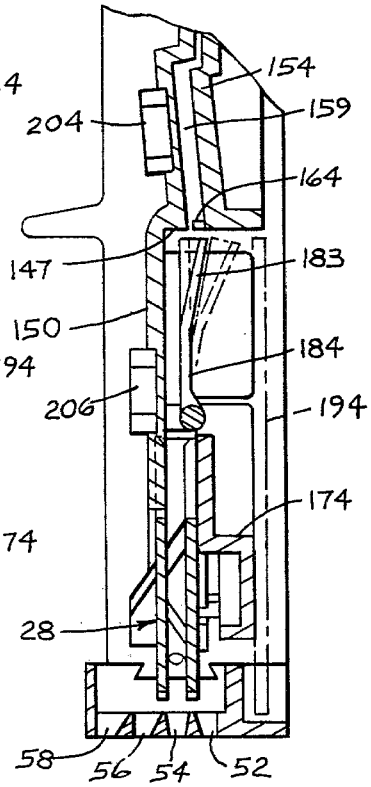
Fig. 8.
Fig. 3.
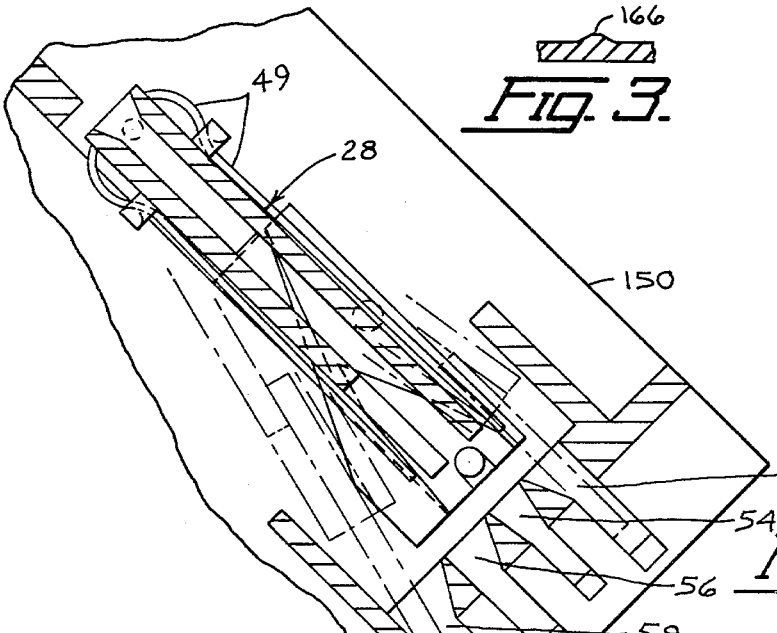
Fig. 9.
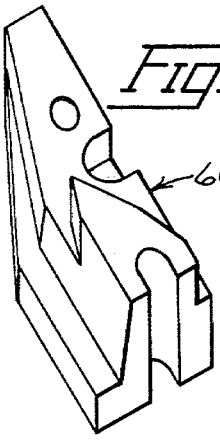
Fig. 10.

+12V
+24V
V30
V30Q
V30D
V30N
+11.75V

COIN-HANDLING DEVICE

BACKGROUND OF THE INVENTION

An electronic slug rejector which is highly effective in distinguishing authentic coins from slugs, and which also is highly effective in distinguishing between those authentic coins, is shown and described in U.S. application Ser. No. 913,161 which was filed on July 6, 1978 and which issued June 30, 1981 as U.S. Pat. No. 4,275,806 and which corresponds to Japanese application Ser. No. 66,971/77 which was filed on June 7, 1977, in U.S. application Ser. No. 913,165 which was filed on June 6, 1978 and which issued Mar. 24, 1981 as U.S. Pat. No. 4,257,435 and which corresponds to Japanese application Ser. No. 66,973/77 which was filed on June 7, 1977, in U.S. application Ser. No. 913,275 which was filed on June 7, 1978 and which issued Oct. 21, 1980 as U.S. Pat. No. 4,228,811 and which corresponds to Japanese application Ser. No. 66,972/77 which was filed on June 7, 1977, in U.S. application Ser. No. 917,429 which was filed on June 20, 1978 and which issued June 10, 1980 as U.S. Pat. No. 4,206,775 and which corresponds to Japanese application Ser. No. 73,726/77 which was filed on June 21, 1977, and/or in U.S. application Ser. No. 928,023 which was filed on July 25, 1978 and which corresponds to Japanese application Ser. No. 89095/77 which was filed on July 25, 1977. That electronic slug rejector has an authenticity-determining magnetic coil which serves as one leg of a plurality of Wien bridges, it has a light-sensitive element which is mounted in advanced of that authenticity-determining coil to detect objects rolling toward that authenticity-determining coil, and it has a light-sensitive element which is mounted beyond that authenticity-determining coil to detect objects rolling away from that authenticity-determining coil. Although that electronic slug rejector is highly effective, it may occasionally accept a copper slug that has dimensions which enable it to interact with the authenticity-determining magnetic coil to cause that authenticity-determining coil to produce an output which is similar to the output that an authentic coin causes that authenticity-determining coil to produce.

SUMMARY OF THE INVENTION

The present invention provides a copper-detecting system which effects the rejection of copper slugs while effecting the acceptance of authentic coins by causing a magnetic coil to resonate at a high frequency so its output waveform will be damped to a lesser extent by a copper slug than it will be damped by an authentic coin. The smaller damping of that high frequency output waveform, when a copper slug is present, is in contrast to the marked damping of a low frequency output waveform by such a slug. The lesser damping of that high frequency output by a copper slug provides a more readily-detectable difference between the relative dampings, due to an authentic coin or a copper slug, than can be obtained with a lower frequency output waveform. It is, therefore, an object of the present invention to provide a copper-detecting system wherein a resonant circuit produces a high frequency output waveform which will interact with a copper slug to be damped to a lesser extent than it will be damped by an authentic coin.

The copper-detecting system of the present invention utilizes a magnetic coil and a capacitor to form a resonant circuit, and it uses an oscillator, which enables that resonant circuit to resonate at a frequency greater than eight hundred thousand Hertz (800,000 Hz). That resonant circuit and that oscillator preferably will be made to cause the resonant frequency to be as much higher than eight hundred thousand Hertz (800,000 Hz) as the stray capacitance of that coil and of that system will permit. Where the resonant frequency is greater than eight thousand Hertz (800,000 Hz), the damping of the resulting output waveform, due to an authentic coin, will not only be greater than the damping of that output waveform, due to a copper slug, but the difference between those dampings will be great enough to facilitate ready distinguishing of the damping which is due to an authentic coin from the damping which is due to a copper slug. It is, therefore, an object of the present invention to provide a copper-detecting system which utilizes a magnetic coil and a capacitor to constitute a resonant circuit with a resonant frequency of at least eight hundred thousand Hertz (800,000 Hz).

The electronic slug rejector of the said U.S., and the said corresponding Japanese, applications disposes a first light-sensitive element in advance of the authenticity-determining coil and disposes a second light-sensitive element beyond that authenticity-determining coil, and it uses those light-sensitive elements to establish timing periods. If an object is sensed by the first of those light-sensitive elements, and is not subsequently sensed within a predetermined period of time by the second light-sensitive sensor, that slug rejector will reject that object—by keeping the accept-reject gate thereof from moving to the accept position. The present invention utilizes magnetic coils, rather than light-sensitive elements, to help provide the timing periods which are provided in the electronic slug rejector of the said U.S., and the said corresponding Japanese, applications. However, the present invention provides a more effective rejection of copper slugs by using one of those magnetic coils to provide a dual function, namely, help provide the timing periods disclosed by the said U.S., and the said corresponding Japanese, applications, and also by producing an exceptionally effective copper-rejecting action. It is, therefore, an object of the present invention to provide a magnetic coil adjacent the authenticity-determining coil of an electronic slug rejector and to use that magnetic coil to provide the dual functions of helping provide timing periods and of performing an exceptionally-effective copper-rejecting action.

Other and further objects and advantages of the present invention should become apparent from an examination of the drawing and accompanying description.

In the drawing and accompanying description, one embodiment of the present invention is shown and described but it is to be understood that the drawing and accompanying description are for the purpose of illustration only and do not limit the invention and that the invention will be defined by the appended claims.

BRIEF DESCRIPTION OF THE DRAWING

In the drawing,

FIG. 3 is a sectional view which is taken along the plane indicated by the line 3—3 in FIG. 1, FIG. 6 is a partially broken-away, sectional view which is taken along the plane indicated by the line 6—6 of FIG. 1, FIG. 7 is another partially broken-away sectional view, and it is taken along the plane indicated by the line 7—7 of FIG. 1, FIG. 8 is a broken-away sectional view which is taken along the broken plane indicated by the broken line 8—8 of FIG. 1, FIG. 9 is a sectional view, on a larger scale, which is taken along the plane indicated by the line 9—9 of FIG. 4, FIG. 10 is a perspective view of a cam block which is used in the slug rejector of FIG. 1, FIGS. 11–13 show the circuit of the embodiment of slug rejector shown in FIG. 1.

DETAILED DESCRIPTION OF PREFERED EMBODIMENT

Figure 5:
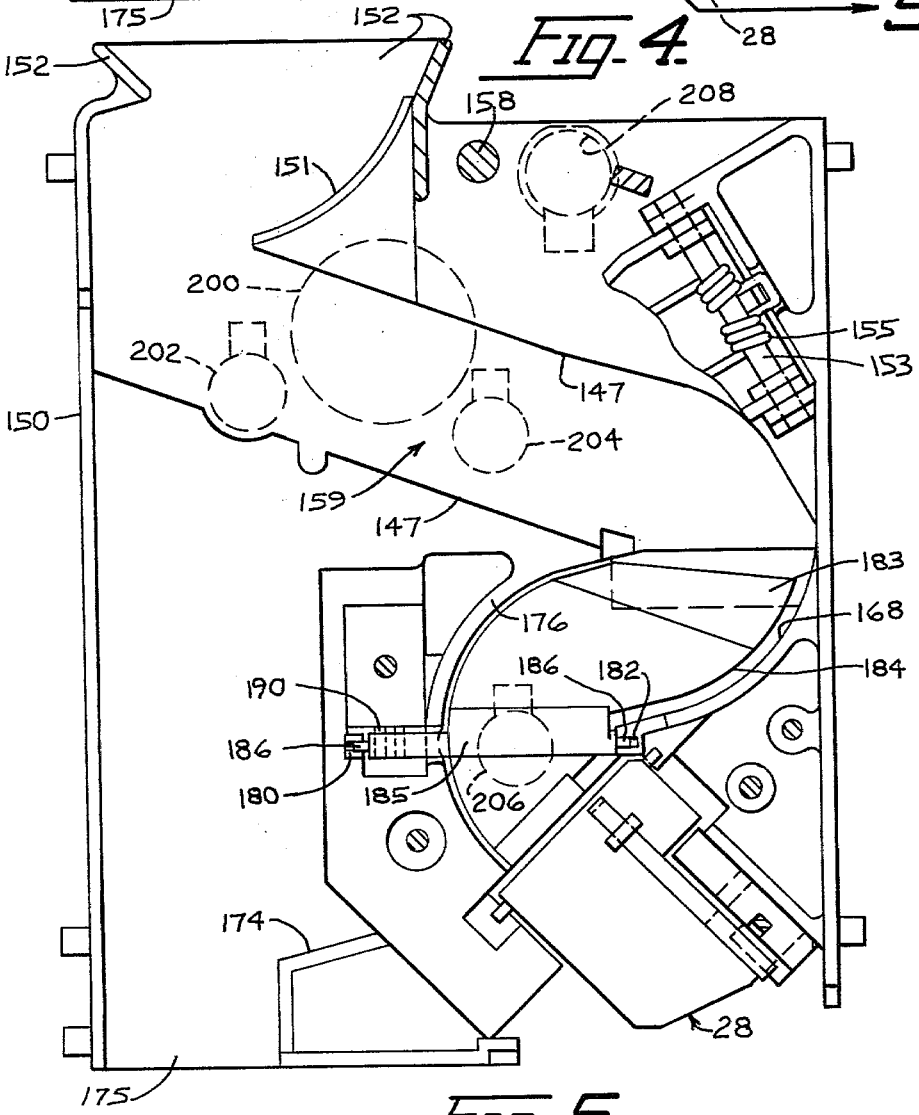
FIG. 5 is a partially broken-away vertical section of the slug rejector of FIG. 1 after a confining plate has been removed from the lower portion thereof.

The numeral 150 denotes the main plate of an electronic slug rejector which is made in accordance with the principles and teachings of the present invention. That main plate has coin slots 52, 54, 56 and 58 adjacent the bottom thereof, as shown particularly by FIGS. 8 and 9. A scavenger gate 154 is pivotally secured to that main plate by a pivot 153. A torsion spring 155 encircles that pivot to urge that scavenger gate toward a position wherein it is parallel to that main plate. As a result, that main plate and that scavenger gate coact to define a coin passageway which is denoted by the numeral 159, and which is shown particularly by FIGS. 6–8. That runway inclines downwardly from upper left toward lower right, as indicated by FIG. 5. That runway tilts upwardly and rearwardly from a forwardly-projecting edge 147 at the front face of main plate 150, as indicated by FIGS. 6–8.

A funnel-like structure is located above that passageway; and three sides of that funnel-like entrance are defined by an upwardly-extending projection 152 which is U-shaped in plan. The fourth side of that funnel-like entrance is defined by an upwardly-extending projection 156 at the upper edge of scavenger gate 154. The numeral 151 denotes an arcuate guide on the front face of main plate 150; and that guide is located below, but in register with, the funnel-like entrance. That guide is intended to intercept coins that pass downwardly through that funnel-like entrance, and thereby absorb some of the kinetic energy in those coins while directing those coins to the left.

The numeral 162 denotes a metal block which is secured to the inner face of scavenger gate 154, and which lies in the path of all coins that pass downwardly through the funnel-like entrance and are guided to the left by the arcuate guide 151. Those coins will fall downwardly onto that metal plate and will be forced to come to rest, and then will start rolling in the opposite direction along a runway 164 which is formed on the inner face of scavenger gate 154 and which inclines downwardly and to the right from the upper edge of metal block 162. A generally-vertical coin-guiding projection 166 is formed at the inner face of that scavenger gate, and it will guide coins toward the main plate 150. The leading and trailing edges of that coin-guiding projection are chamfered, as shown by FIG. 3. The numeral 147 denotes a ledge, which extends forwardly from the front face of main plate 150 and which coacts with the runway 164 on scavenger gate 154 to define the upper and lower limits of the coin passageway 159.

Figure 2:
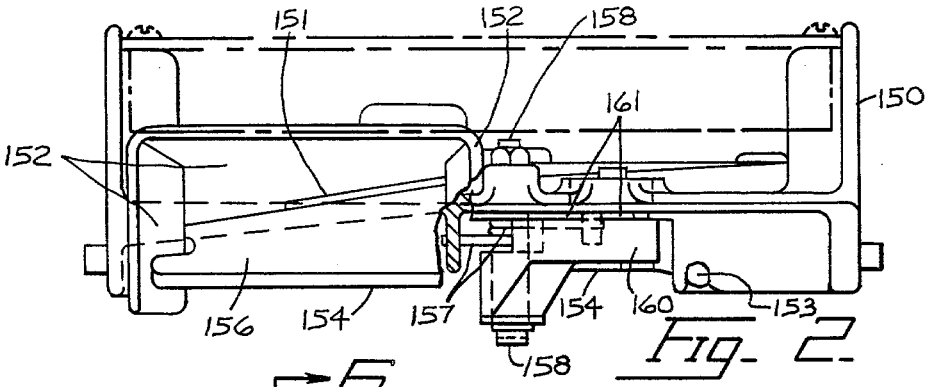
FIG. 2 is a partially broken-away plan view of the slug rejector of FIG. 1.
Figure 1:
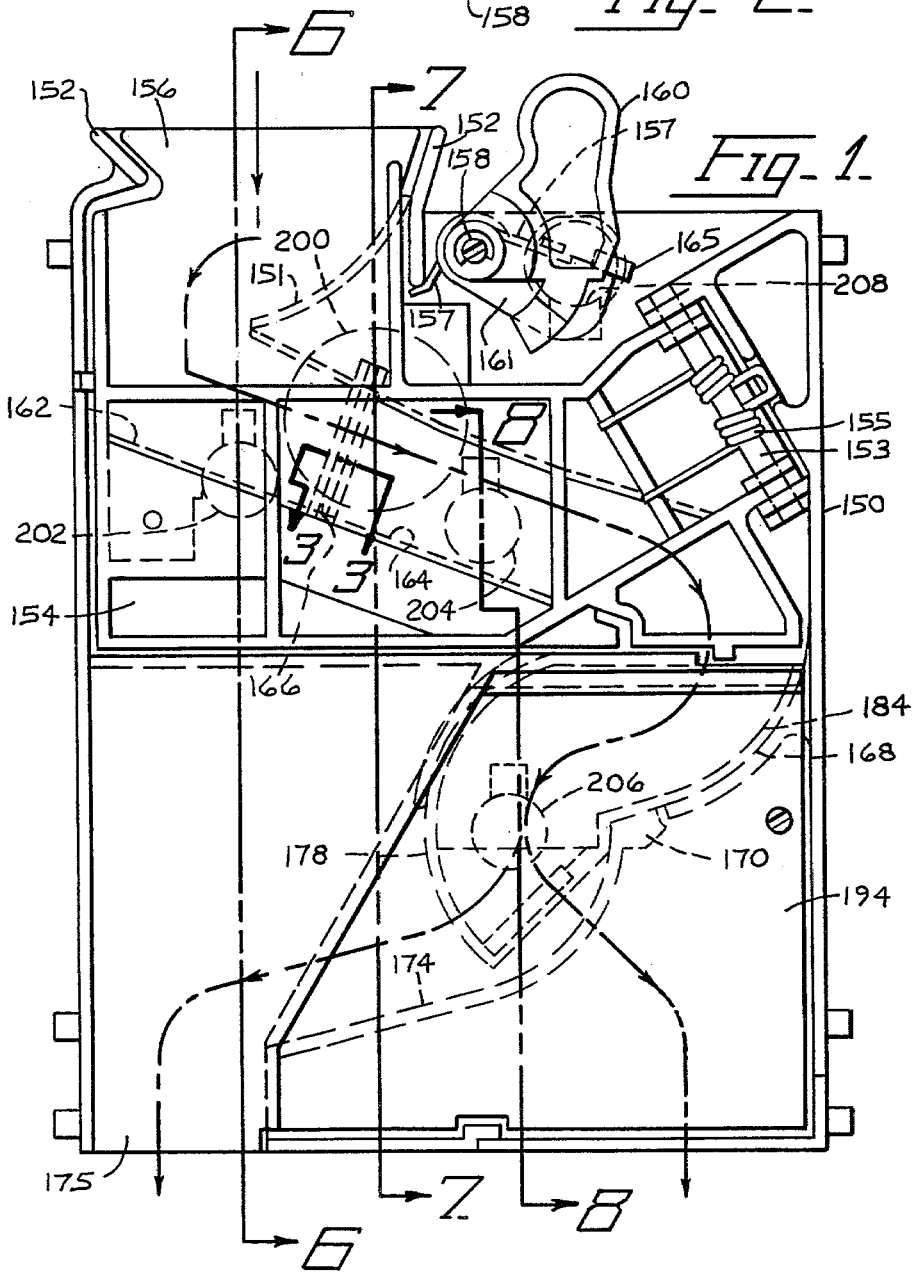
FIG. 1 is a front elevational view of one embodiment of electronic slug rejector that is made in accordance with the principles and teachings of the present invention.
Figure 4:
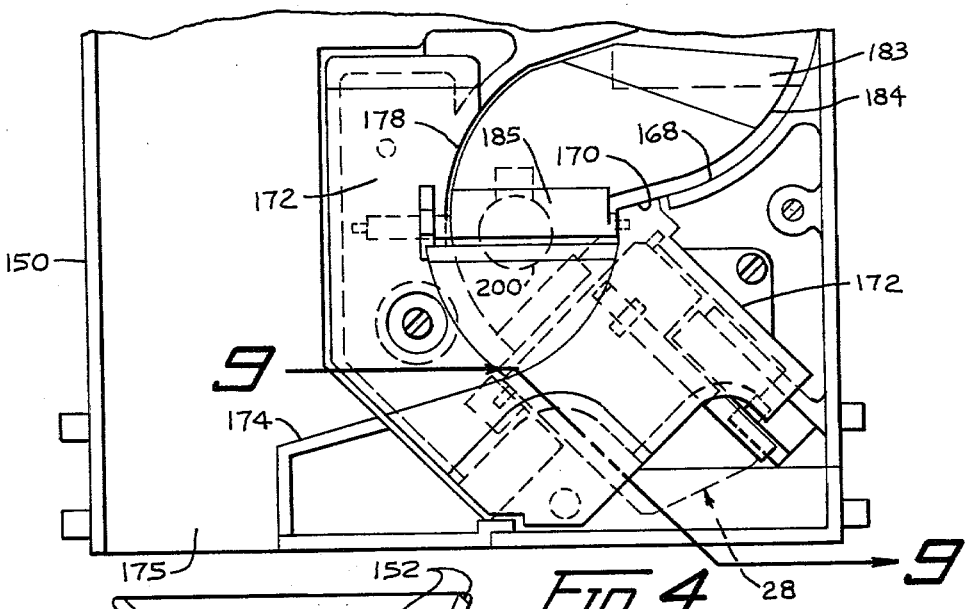
FIG. 4 is a vertical sectional view of the lower portion of the slug rejector of FIG. 1 after the cover plate for that portion has been removed.

A horizontally-directed pivot 158 is mounted on the main plate; and it rotatably supports a cancel sale lever 160. A torsion spring 157 urges that lever to the upper position shown by FIG. 1; but that lever can be moved downwardly. A ferrous metal plate 161 is mounted on, and movable with, lever 160; and a magnetic coil 208 is mounted on main plate 150 so it normally will have metal plate 161 disposed in front of it. However, that metal plate will be moved away from that coil whenever lever 160 is moved downwardly. A cam face 165 is provided on lever 160; and that cam face will engage the upper edge of scavenger gate 154 to move that gate away from main plate 150 whenever lever 160 is moved downwardly. The numeral 168 denotes an arcuate guide on the front face of main plate 150; and it is generally below, and in register with, the outlet of passageway 159. The numeral 170 denotes a continuation of arcuate guide 168 which is at the rear face of a confining plate 172 for a coin direction 28. A guiding portion 174 on the outer face of confining plate 172 guides unacceptable coins and slugs to reject outlet 175.

The numeral 178 denotes a concave edge for the upper portion of confining plate 172 which is in register with an arcuate rib 176 on the front of main plate 150. The numerals 180 and 182 denote slots in forwardly-extending bosses on that main plate; and those slots accommodate the opposite ends of the pivot 186 of the accept/reject gate 184. That gate has a rearwardly-inclined upper edge 183, and also has a forwardly and downwardly inclined offset 185 adjacent the middle thereof. A solenoid 188 is mounted in a recess in main plate 150; and the plunger 190 of that solenoid extends downwardly and is connected to the cylindrical projection at the left of accept/reject gate 184 by a wire 192.

The main plate, the scavenger gate, the confining plate 172, the accept/reject gate 184, and a cover plate 194 preferably are made of plastic material. Also those parts preferably will be made by moulding operations. That wire enables vertical movement of plunger 190 to effect rotation of accept/reject gate 184. The cover plate 194 is a large plate which ordinarily overlies and conceals the confining plate 172.

The numeral 200 denotes a magnetic coil which is mounted within a cylindrical recess in the rear face of the main plate 150; and the forward face of the core of that coil is located within a millimeter of the rear face of passageway 159. The coil is the authenticity-determining coil of the electronic slug rejector. The numeral 202 denotes a second magnetic coil which is mounted within a cylindrical recess in that main plate, and the numeral 204 denotes a third magnetic coil which is mounted within a cylindrical recess in that main plate. Those magnetic coils are close to the level of the edge 147 which defines the lower limit of passageway 159, as shown by FIG. 5. The cores for the coils 202 and 204 are small enough, and they are close enough to the runway 164 on scavenger gate 154, that a dime will be substantially completely coextensive with each of those coils as that dime successively moves into register with those coils. The core of the coil 200 is larger than a dollar coin, and the lower edge thereof is displaced further from runway 164 than is the core of either of the coils 202 and 204. However, that core is close enough to that runway so portions of all coins will be coextensive with the lower portion of that coil as those coins move past that coil. The numeral 206 denotes a fourth magnetic coil which is mounted within a cylindrical recess in main plate 150; and that coil is located about the level of the pivot 186 for accept/reject gate 184. The numeral 208 denotes a fifth magnetic coil which is mounted within a cylindrical recess in that main plate; and it is normally overlain by the ferrous plate 161 on the cancel sale lever 160.

Figures 11, 12, 13, 14:
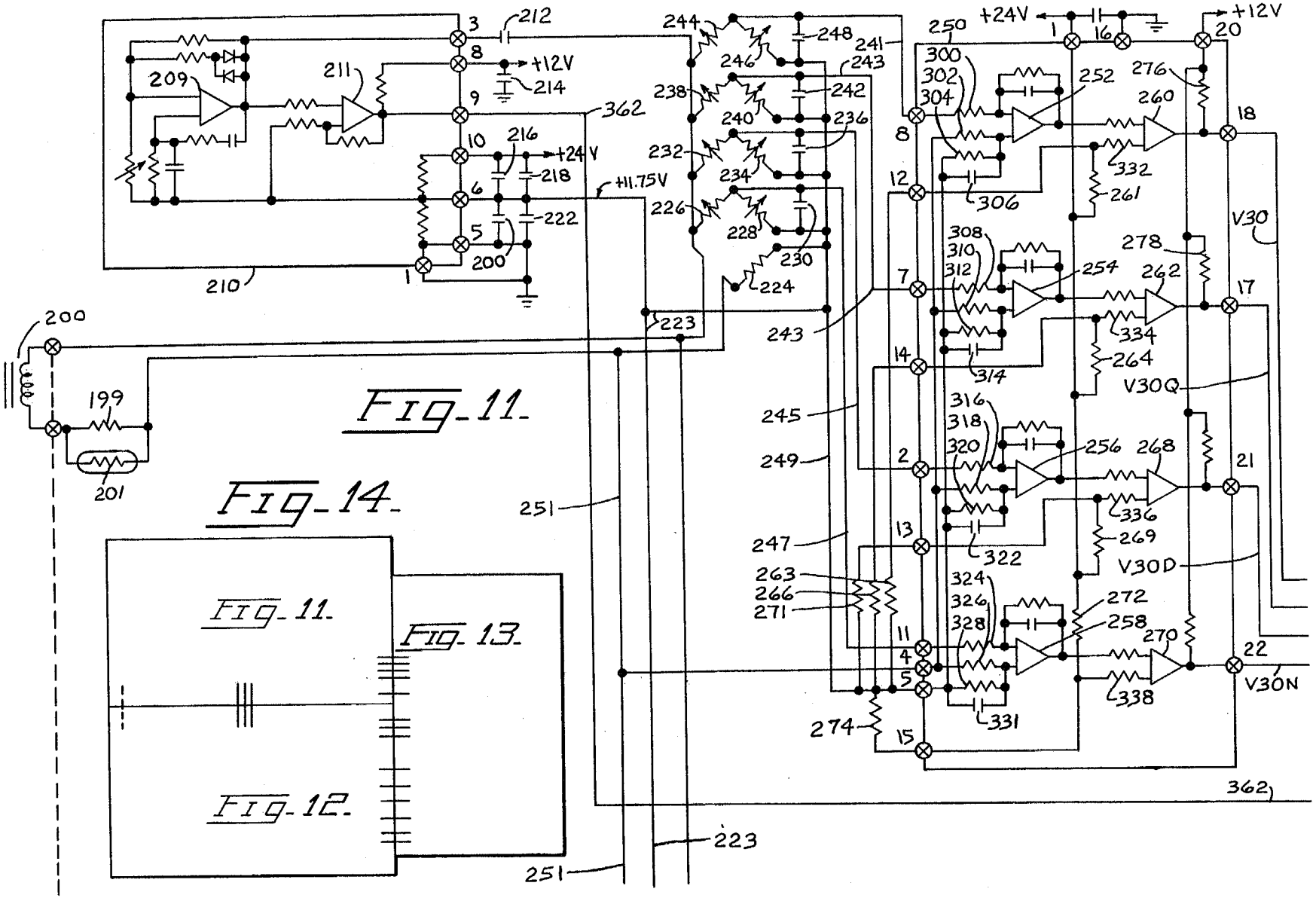
FIG. 14 is a chart showing how
FIGS. 11–13 are interrelated.
Figure 12:
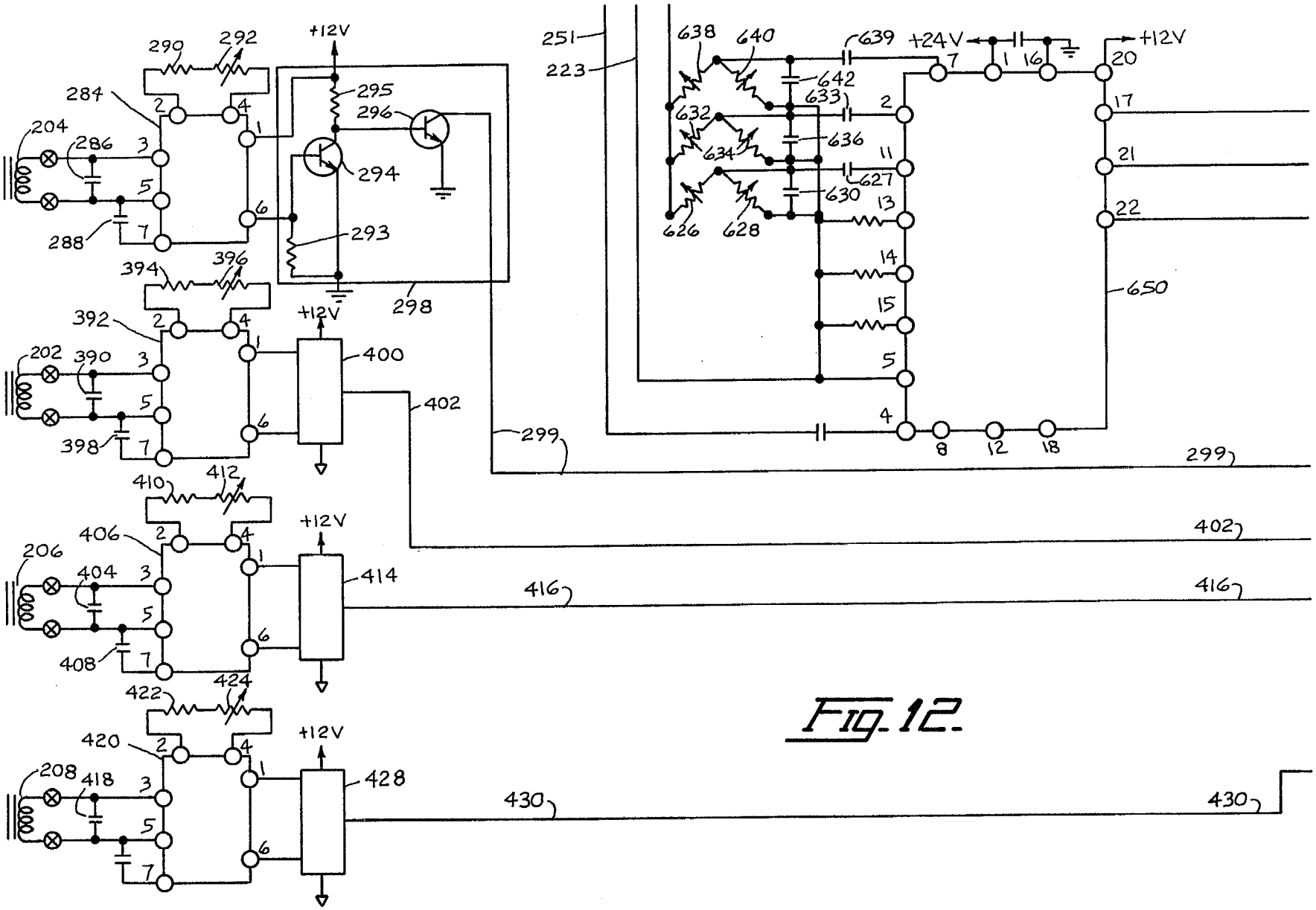
Figure 13:
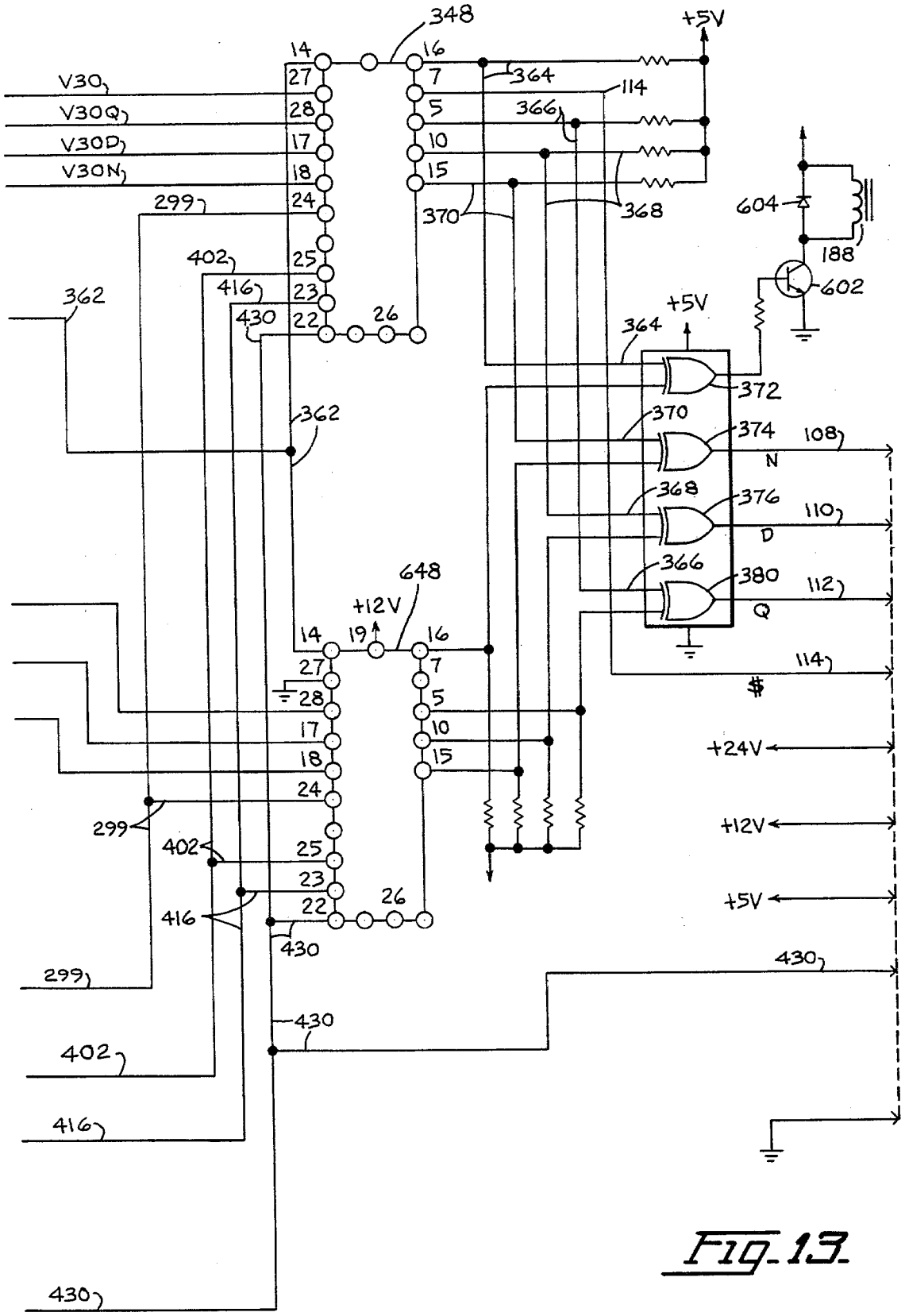

The numeral 210 in FIG. 11 denotes a Bias And Oscillator Chip Hybrid; and that chip includes a Fairchild NA759 power operational amplifier 209 and a Motorola MLM311P1 comparator 211. Various devices could be used as integrated circuit 210, but the J-4307 chip of Kipco Division Omnetics is preferred. That chip receives regulated plus twenty-four (+24) volts at pin 10 thereof and regulated plus twelve (+12) volts at pin 8 thereof from a standard and usual regulated power supply. The numerals 214, 216, 218, 200 and 222 denotes filtering capacitors which by-pass to ground any ripple, noise or other transients. Integrated circuit 210 develops a four and one-tenth kilohertz (4.1 kh) frequency; and pin 3 and a couping capacitor 212 apply that frequency to one terminal of coil 200 and to one terminal of each of two thousand (2k) ohm adjustable resistors 226, 232, 238, 244, 626, 632 and 638. That frequency also is applied to pin 14 of each of integrated circuits 348 and 648 of FIG. 13 by pin 9 and conductor 362. Pins 1 and 5 of chip 210 are grounded; and pin 6 and conductor 223 supply a regulated and filtered twelve (12) volts to the right-hand terminals of parallel-connected adjustable resistor 246 and capacitor 248, of parallel-connected adjustable resistor 240 and capacitor 242, of parallel-connected adjustable resistor 234 and capacitor 236, of parallel-connected adjustable resistor 228 and capacitor 230, and of fixed resistor 224. That regulated and filtered twelve (12) volts also is supplied to pin 5 of each of integrated circuits 250 and 650. Further that regulated and filtered twelve (12) volts also is supplied to the right-hand terminals of parallel-connected adjustable resistor 640 and capacitor 642, of parallel-connected adjustable resistor 634 and capacitor 636, and of parallel-connected adjustable resistor 628 and capacitor 630. All of the adjustable resistors 228, 234, 240, 246, 628, 634 and 640 are twenty thousand (20k) ohm adjustable resistors; and resistor 224 is a sixty-eight hundred and ten (6810) ohm resistor.

The integrated circuit 250 is a Bridge Hybrid Chip J-4305 by kipco Division Omnetics which contains differential amplifiers 252, 254, 256 and 258 of standard and usual design. That chip also contains comparators 260, 262, 268 and 270 of standard and usual design. The output 18 of that chip is connected, via conductor V30, to pin 27 of integrated circuit 348 which is shown in greater detail in FIGS. 15–16; and output 17 is connected, via conductors V300, to pin 28 of integrated circuit 348. The output 21 is connected, via conductor V30D, to pin 17; and the output 22 is connected, via conductor V30N, to pin 18 of integrated circuit 348.

Coil 200 and resistor 224 constitute one-half of each of four Wien bridges—the other halves of those four bridges being, respectively, adjustable resistors 226 and 228, adjustable resistors 232 and 234, adjustable resistors 238 and 240, and adjustable resistors 244 and 246. Resonating capacitors 230, 236, 242 and 248 are connected, in parallel with adjustable resistors 228, 234, 240 and 246.

Resistors 261 and 263 are connected between plus twenty-four (+24) volts at pin 1 of integrated circuit 250 and plus twelve (+12) volts at pin 5 to enable resistor 332 to apply a fixed bias to the non-inverting input of comparator 260; and resistors 264 and 266 are connected between that plus twenty-four (+24) volts and that plus twelve (+12) volts to enable resistor 334 to apply a fixed bias to the non-inverting input of comparator 262. Resistors 269 and 271 are connected between that plus twenty-four (+24) volts and that plus twelve (+12) volts to enable resistor 336 to apply a fixed bias to the non-inverting input of comparator 268; and resistors 272 and 274 are connected between the plus twenty-four (+24) volts and that plus twelve (+12) volts to enable resistor 338 to apply a fixed bias to the non-inverting input of comparator 270. Parallel-connected resistor 304 and capacitor 306, parallel-connected resistor 312 and capacitor 314, parallel-connected resistor 320 and capacitor 322, and parallel-connected resistor 328 and capacitor 331, respectively, connect the plus twelve (+12) volts at pin 5 of chip 250 to the non-inverting inputs of differential amplifiers 252, 254, 256 and 258. A parallel-connected resistor 199 and thermistor 201 connect one terminal of coil 200 to resistor 224, and conductor 251 and resistors 302, 310, 318 and 326, respectively, connect the lower outputs of the four Wien bridges to the non-inverting inputs of comparators 252, 254, 256 and 258. Conductors 241, 243, 245 and 247, respectively, connect the upper outputs of those bridges to the inverting inputs of those comparators via resistors 300, 308, 316 and 324. Each of the comparators has a standard and usual parallel-connected resistor and capacitor connected between its output and its inverting input to provide feed back.

The four differential amplifiers 252, 254, 256 and 258 of chip 250 are intended to, and do, perform the same functions which are performed by the four differential amplifiers in FIG. 3 of said U.S. application Ser. No. 917,429 and of the corresponding Japanese application Ser. No. 73726/77. Similarly, the four comparators 260, 262, 268 and 270 are intended to, and do, perform the same functions which are performed by the four comparators in FIG. 3 of said U.S. application and of the corresponding Japanese application.

The numerals 284, 392, 406 and 420 denote integrated circuits which receive input signals, respectively, from a resonating circuit including the coil 204 and a resonating capacitor 286, the coil 202 and a resonating capacitor 390, the coil 206 and a resonating capacitor 404, and the coil 208 and a resonating capacitor 418. Resistors 290, 394, 410 and 422 and adjustable resistor 292, 396, 412 and 424 are connected between pins 2 and 4 of those integrated circuits, as shown by FIG. 12. Those integrated circuits could be of different kinds, but NPC31DP integrated circuits of Nucleonics Products Company are useful. Those integrated circuits include oscillators which supply predetermined frequencies to parallel-resonant coil 204 and capacitor 286, coil 202 and capacitor 390, coil 206 and capacitor 404, and coil 208 and capacitor 418. In one preferred embodiment of the present invention, the coil 204 is mounted in one-half of a pot core of E-shaped cross-section which has an outer diameter of fourteen millimeters (14 mm); and that coil has forty (40) turns of 7/24 Litz wire. The capacitor 286 is a one hundred picofarad (100 pf) capacitor. The coil 204 and the capacitor 286 will resonate in the range of one and six-tenths megahertz (1.6 MHz). The capacitor 390 is a two hundred and twenty picofarad (220 pf) capacitor, and it coacts with coil 202 to resonate in the range of six hundred and thirty kilohertz (630 KHz). The capacitor 404 is a six hundred and eighty picofarad (680 pf) capacitor, and it coacts with coil 206 to resonate in the range of three hundred and seventy kilohertz (370 KHz). The capacitor 418 is a two hundred and twenty picofarad (220 pf) capacitor, and it coacts with coil 208 to resonate in the range of six hundred and thirty kilohertz (630 KHz).

The resonant frequency of coil 204 and capacitor 286 is critical, in the sense that it must be greater than eight hundred kilohertz (800,000 Hz). At frequencies below eight hundred kilohertz (800,000 Hz) a copper slug can cause a greater damping of the output waveform of a resonant circuit than can an authentic coin; and the differences between the damping effects provided by a copper slug and by an authentic coin are not always distinguishable. In contrast, at frequencies above eight hundred kilohertz (800,000 Hz), the damping of the output waveform of a resonant circuit by a copper slug is less than the damping of that output waveform by an authentic coin; and the differences between the damping effects provided by a copper slug and by an authentic coin are readily distinguishable.

In contrast, the resonant frequencies of coil 202 and capacitor 390, of coil 206 and capacitor 404, and of coil 208 and capacitor 418 are not critical. Specifically, any or all of the those resonant frequencies could be set anywhere in the range from ten kilohertz (10 KHz) to seven hundred kilohertz (700 KHz). However, to minimize "cross talk" between the conductors which extend between the coils 202, 204, 206 and 208, which are mounted on the main plate 150, and the capacitors 390, 286, 404 and 418 and chips 392, 284, 406 and 420, which are mounted on a circuit board that is secured to that main plate, it is desirable to set the resonant frequency of capacitor 404 and coil 206—which is closer to each of coils 202 and 208 than those coils are to each other—at a value which is quite different from the value of the frequency at which coil 202 and capacitor 290, and at which coil 208 and capacitor 418, are set.

The numerals 298, 400, 414 and 428 denote amplifiers; and each of those amplifiers includes an NPN transistor 294 with a resistor 293 connected between its base and ground, and with a resistor 295 connected between its collector and plus twelve (+12) volts. Each of those amplifiers also includes an NPN transistor 296 which has its base connected to the collector of transistor 294 and which has its collector as the output of that amplifier. The base of transistor 294 of each amplifier 298, 400, 414 and 428 is connected to pin 6 of the adjacent integrated circuit 284, 392, 406 and 420, respectively. A conductor 299 extends from the output of amplifier 298 to pin 24 of each of integrated circuits 384 and 648, a conductor 402 extends from the output of amplifier 400 to pin 25 of each of those integrated circuits, a conductor 416 extends from the output of amplifier 414 to pin 23 of each of those integrated circuits, and a conductor 430 extends from the output of amplifier 428 to pin 22 of each of those integrated circuits and also to pin 6 of Port 0 of the microprocessor in the said Hasmukh R. Shah et al application Ser. No. 137524 for CONTROL DEVICE which is filed of even date.

Figure 15:
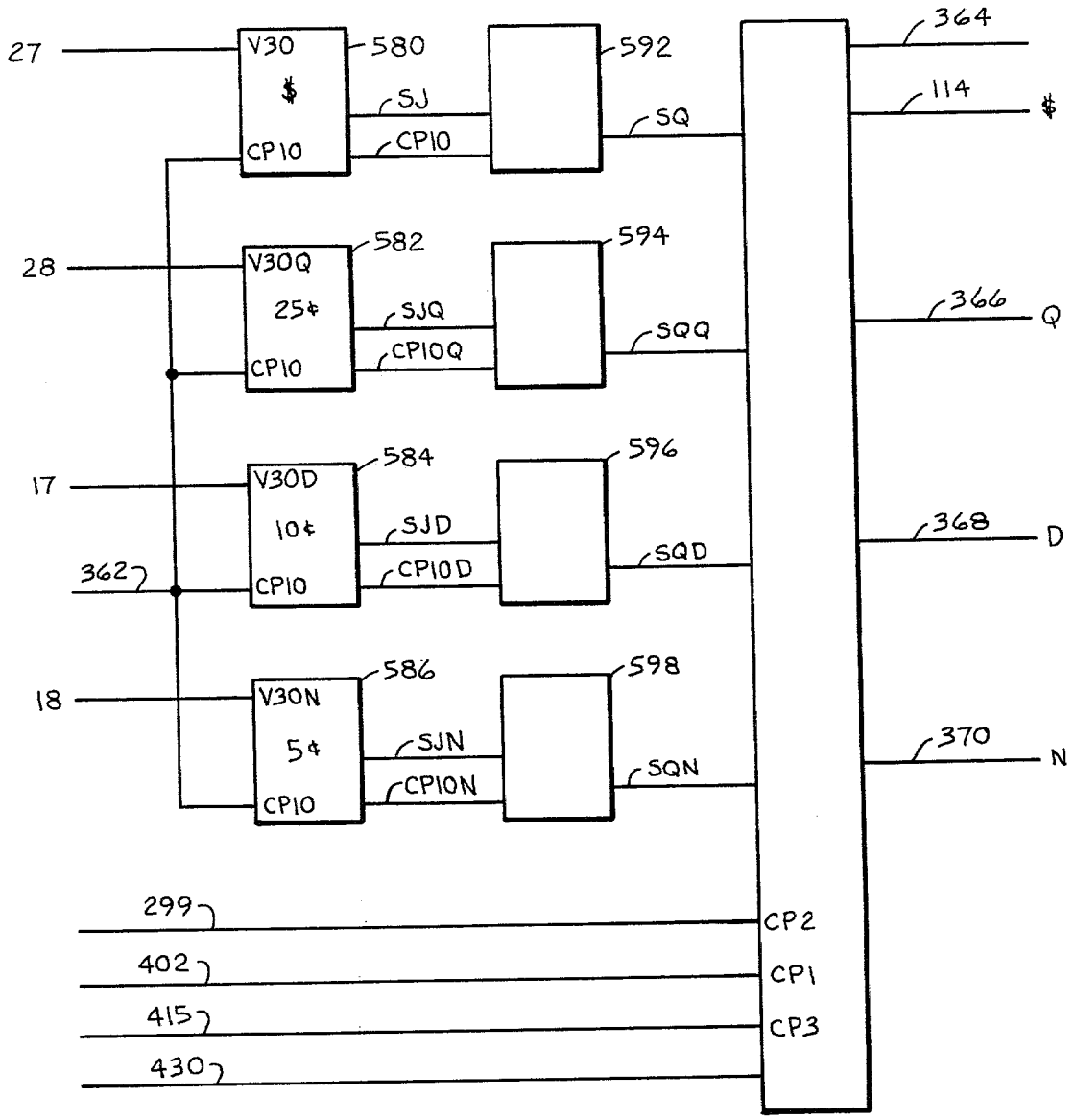
FIG. 15 shows, in block form, components which are used in the two integrated circuits of FIG. 13.

Referring particularly to FIG. 15, the numerals 580, 582, 584 and 586 denote blocks, each of which consists of the circuit of FIG. 5 of said U.S. application Ser. No. 917,429 and of corresponding Japanese application Ser. No. 73726/77. The upper inputs of those blocks are connected, respectively, to V30 by pin 27, V30Q by pin 28, V30D by pin 17, and V30N by pin 18 of integrated circuit 348. The lower inputs of all of those blocks are connected together and to output pin 9 of integrated circuit 210 by conductor 362; and hence each of those blocks receives the four and one-tenth kilohertz (4.1 KHz) frequency from that integrated circuit. That frequency will be used by the circuitry in each of those blocks as a reference frequency. Each of those blocks includes an inverter which serves as the input, three AND gates—each of which has one input thereof connected to the output of that inverter, three set-reset flip-flops—each of which has its R input connected to the output of a corresponding AND gate, three further AND gates connected to the Q outputs of the flip-flops and an OR gate which is connected to the outputs of the second set of AND gates. Those NOR gates serve as the outputs of the blocks 580, 582, 584, and 586; and they can supply signals to conductors SJ, SJQ, SJD and SJN. Also, each of those blocks has a three phase clock generator which consists of D-type flip-flops, that have the toggle inputs thereof connected to conductor 362. The outputs of that three phase pulse generator supply pulses to the AND gates and to the flip-flops of that block, all as described in connection with FIG. 5 of U.S. application Ser. No. 917,429 and the corresponding Japanese application Ser. No. 73726/77. Branches of conductor 362 extends through each of those blocks; and they are identified, as they exit from those blocks, as CP10, CP10Q, CP10D and CP10N, respectively. Those branches will supply a reference pulse train to each of blocks 592, 594, 596 and 598.

The blocks 592, 594, 596 and 598 in FIG. 15 are blocks which receive signals from the blocks 580, 582, 584 and 586, respectively, via conductors SJ, SJQ, SJD and SJN. Each of the blocks 592, 594, 596 and 598 consists of the circuit of FIG. 7 of said U.S. application Ser. No. 917,429 and of corresponding Japanese application Ser. No. 73726/77; and hence includes three D-type flip-flops, two three-input AND gates, and a set-rest flip-flop. The data input of the first D-type flip-flop of each block 592, 594, 596 and 598 receives signals, respectively, from conductors SJ, SJQ, SJD and SJN, and hence from the outputs of blocks 580, 582, 584 and 586. The AND gate, in each block, which is connected to the Q outputs of the D-type flip-flops is connected to the S input of the set-reset flip-flop; and the AND gate which is connected to the $\overline{Q}$ outputs of those flip-flops is connected to the R input of that set-reset flip-flop. The output of the set-reset flip-flop of each of the blocks 592, 594, 596 and 598 is denoted, respectively, as SQ, SQQ, SQD and SQN. The conductor 362 is connected to the toggling inputs of all of the D-type flip-flops. The function and operation of the components of the blocks 592, 594, 596 and 598 are the same as the function and operation of the components shown in FIG. 7 of U.S. application Ser. No. 917,429 of corresponding Japanese application Ser. No. 73726/77.

The output of the authenticity-determining coil 200 will include therein all signals which are developed as coins or slugs move past that coil; and all of those signals will be applied to the inputs of all of the four Wien bridges which have coil 200 and resistor 224 as two legs thereof. Those bridges will respond to slugs by producing either no null or two or more nulls, as explained in said U.S. and Japanese applications, and particularly by U.S. application Ser. No. 913,161 and corresponding to Japanese application Ser. No. 66971/77. The differential amplifiers 252, 254, 256 and 258 respond to the waveforms from those bridges to provide square waves which have envelopes that are comparable to the envelopes of the output waveforms from those bridges. The comparators 260, 262, 268 and 270 compare those square waves with a fixed reference voltage. If the square wave output of a differential amplifier 252, 254, 256 or 258 does not indicate a null, the output of the corresponding comparator also will be a square wave. However, if the output from the differential amplifier indicates a null, the output of the corresponding comparator 260, 262, 268 or 270 will be a square wave up to the initiation of the null, will be a fixed amplitude throughout the duration of that null, and then will again be a square wave, all as shown and illustrated by waveforms in said U.S. and Japanese applications, and particularly in U.S. application Ser. No. 917,429 and corresponding Japanese application Ser. No. 73726/77.

The signals at the SQ, SQQ, SQD and SQN outputs, respectively, of blocks 592, 594, 596 and 598 will be steady logic "0"s as long as the wave forms at the inputs V30, V30Q, V30D, and V30N to those blocks are square waves. However, when any one of those wave forms becomes a steady state—thereby indicating the presence of a null—and remains such for a minimum period of time—two milliseconds (2 ms) in the preferred embodiment—the signal on the corresponding SQ, SQQ, SQD or SQN output would be a logic "1". That signal would have a duration corresponding to the duration of the null on the corresponding V30, V30Q, V30D or V30N conductor.

An authentic coin will cause a single null to be developed, and hence will cause a single positive-going pulse to appear on SQ, SQQ, SQD or SQN. A counterfeit, or a coin of another nation, will provide either no null or two or more nulls and hence will either provide no logic "1" or two or more logic "1"s on SQ, SQQ, SQD or SQN.

Figure 16:
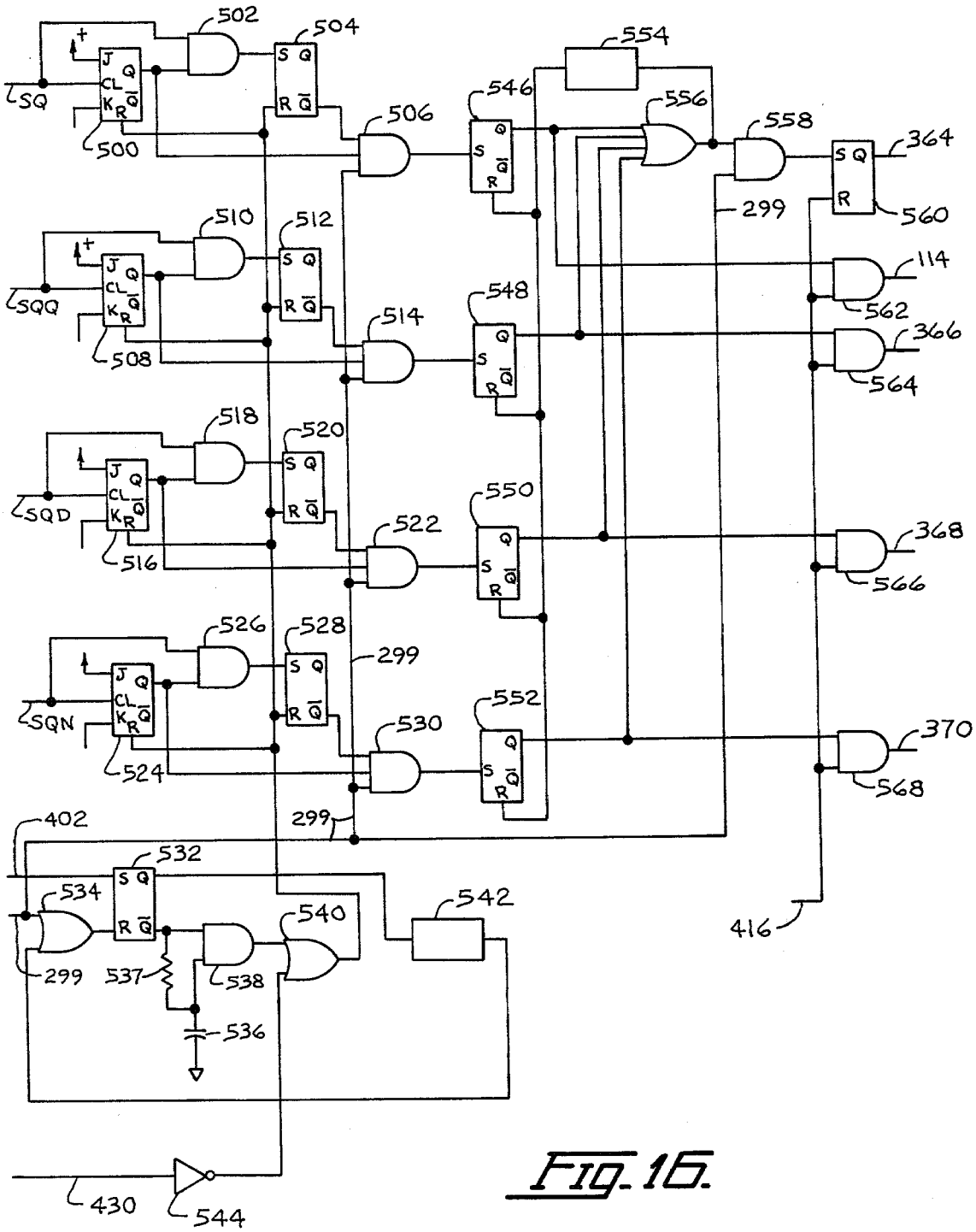
FIG. 16 shows the components of one of the blocks of FIG. 15.

Referring particularly to FIG. 16 the numerals 500, 508, 516 and 524 denote JK flip-flops; and the clock inputs of those flip-flops are connected, respectively, to conductors SQ, SQQ, SQD and SQN from blocks 592, 594, 596 and 598. The numerals 502, 510, 518 and 526 denote AND gates which have the upper inputs thereof connected, respectively, to conductors SQ, SQQ, SQD, and SQN, and which have their lower inputs connected, respectively, to the Q outputs of flip-flops 500, 508, 516 and 524. The numerals 504, 512, 520 and 528 denote set-reset flip-flops which have the set inputs thereof connected, respectively, to the outputs of AND gates 502, 510, 518 and 526. The numerals 506, 514, 522 and 530 denote three input AND gates which have the upper inputs thereof connected, respectively, to the Q outputs of flip-flops 504, 512, 520 and 528. The middle inputs of those three-input AND gates are connected, respectively, to the $\overline{Q}$ outputs of flip-flops 500, 508, 516 and 524. The lower inputs of those AND gates are connected, respectively, to conductor 299 which extends from amplifier 298 of FIG. 12.

Referring particularly to FIG. 16, the numeral 532 denotes a set-reset flip-flop which has the set input thereof connected to conductor 402 which extends from amplifier 400 of FIG. 12. The Q output of that flip-flop is connected to a timer 542 which has the output thereof connected to the lower input of an OR gate 534; and that gate has its output connected to the R input of flip-flop 532. The other input of OR gate 534 is connected to conductor 299. The $\overline{Q}$ output of flip-flop 532 is connected to an AND gate 538 which has the output thereof connected to an OR gate 540. An inverter 544 has the input thereof connected to conductor 430 which extends from the amplifier 428 of FIG. 12. The output of that inverter is applied to the lower input of OR gate 540; and the output of that OR gate is connected to the reset inputs of all of the flip-flops 500, 504, 508, 512, 516, 520, 524 and 528. A capacitor 536 has the lower terminal thereof grounded; and it has the upper terminal thereof connected directly to the lower input of AND gate 538 and, via a resistor 537, to the $\overline{Q}$ output of flip-flop 532.

The numerals 546, 548, 550 and 552 denote set-reset flip-flops which have the set inputs thereof connected, respectively, to the outputs of AND gates 506, 514, 522 and 530. The Q outputs of all of those flip-flops are connected to inputs of an OR gate 556; and the Q output of flip-flop 546 also is connected to the upper input of an AND gate 562, the Q output of flip-flop 548 also is connected to the upper input of an AND gate 564, the Q output of flip-flop 550 is connected to the upper input of an AND gate 566, and the Q output of flip-flop 552 also is connected to the upper input of an AND gate 568. A timer 554 has its input connected to the output of OR gate 556, and it has its output connected to the R inputs of each of the flip-flops 546, 548, 550 and 552. The upper input of an AND gate 558 also is connected to the output of OR gate 556; and the lower input of that AND gate is connected to conductor 299. The output of AND gate 558 is connected to the set input of a set-reset flip-flop 560; and the Q output of that flip-flop is connected to conductor 364—which extends through pin 16 of integrated circuit 348 of FIG. 13 to the upper input of an EXCLUSIVE OR gate 372. The lower inputs of all of the AND gate 562, 564, 566 and 568, and the R input of flip-flop 560, are connected to conductor 416 which extends from the amplifier 414 of FIG. 12. The outputs of those AND gates are connected to conductors 114, 366, 368 and 370; which extend, respectively, through pins 7, 5, 10 and 15, respectively, of integrated circuit 348. Conductors 370, 368 and 366 extend, respectively to the upper inputs of EXCLUSIVE OR gates 374, 376 and 380. Conductors 108, 110, 112 and 114 are connected, respectively, to pins 0 through 3 or Port 1 of the microprocessor of said Shah et al Control Device application Ser. No. 137,524.

If it is assumed that an authentic U.S. dollar coin rolls past the coil 202, that coin will damp the output waveform of the resonant circuit constituted by that coil and capacitor 390; and chip 392 will respond to that damping to provide an output signal. Amplifier 400 will amplify that signal and apply it to the set input of flip-flop 532 via conductor 402. The resulting "1" at the Q output of that flip-flop will start timer 542, and thereby establish a timing period which is less than one (1) second but is slightly longer than the normal time which an authentic coin requires to roll from coil 202 to coil 204.

The outputs of that timer will be a "0" until that timer "times out". The "0" at the $\overline{Q}$ output of that flip-flop will be applied to the upper input of AND gate 538 and to the upper input of resistor 537. At this time, flip-flop 532 will be in its "set" condition, and timer 542 will be maintaining a "0" at its output throughout its timing period.

The dollar will continue to roll along the runway 164; and, as it rolls past the coil 200, it will damp the output waveform from that coil. The Wien bridge which includes coil 200, resistor 224, adjustable resistors 244 and 246 and capacitor 248 will apply a null-indicating damped waveform to the inverting input of differential amplifier 252. The resulting damped square waveform from that amplifier will be supplied to comparator 260; and the null-containing output of that comparator will be applied, via conductor V30, to block 580. The output of that block will be applied, via conductor SJ, to block 592; and the output of the latter block will be applied by conductor SQ to clock input of flip-flop 500 and also to the upper input of AND gate 502. That flip-flop will not provide an immediate response to the signal on conductor SQ, because that flip-flop triggers on negative-going edges. Subsequently, as the logic "1" on conductor SQ changes back to "0", the flip-flop 500 will apply a "1" to the lower input of AND gate 502 and also to the middle input of AND gate 506. Because the upper input of AND gate 502 senses the change from "1" to "0" on conductor SQ at the same instant the CL input of flip-flop 500 senses that change, that AND gate will continue to have a "0" at its output when the Q output of flip-flop 500 applies a "1" to the lower input of that gate and also to the middle input of AND gate 506. At this time, timer 542 will still have a "0" at its output, flip-flop 500 will be "set" and will be applying "1" to the middle input of AND gate 506, and the $\overline{Q}$ output of flip-flop 504 will be applying a "1" to the upper input of that AND gate. No null will have developed at the outputs of the other three Wien bridges, and hence all of flip-flops 508, 516 and 524 will have "0"s at the Q outputs thereof, and will have "1"s at the $\overline{Q}$ outputs thereof.

The function and operation of coil 202 and its associated circuitry will be identical in purpose and result to the function and operation of the initial light sensing element of the electronic slug rejector of said U.S. and corresponding Japanese applications. Also, the function and operation of authenticity-determining coil 200 and its associated circuitry will be identical in purpose and result to the function and operation of authenticity-determining coil of that electronic slug rejector.

The dollar will continue to roll along the runway 164; and, as it rolls past the coil 204, it will damp the output waveform of the resonant current constituted by that coil and capacitor 286, and chip 284 will respond to that damping to provide an output signal. Amplifier 298 will amplify that signal and, via conductor 299 and pin 24 of integrated circuit 348, will apply it to the upper input of OR gate 534 of FIG. 16 and also to the lower inputs of AND gates 506, 514, 522, 530 and 558. The "1" at the lower input of AND gate 506 will coact with the "1"s at the upper and middle inputs of that gate to cause that gate to apply a "1" to the set input of flip-flop 546. The "1" which conductor 299 applies to the lower input of AND gate 558 will coact with the "1" which OR gate 556 will now apply to the upper input of that AND gate to cause a "1" to be applied to the set input of flip-flop 560. The resulting "1" at the output of that flip-flop will be applied, via conductor 364, to EXCLUSIVE OR gate 372; and the resulting "1" at the base of transistor 602 will render that transistor conductive. The resulting flow of current through solenoid 188 will move the accept-reject gate 184 to the accept position. The "1" which conductor 299 applies to OR gate 534 will apply a re-setting signal to flip-flop 532, and, thereupon, the Q output of that flip-flop will change to a "0" to stop the timer 542. The $\overline{Q}$ output of that flip-flop will apply "1" to the upper inputs of AND gate 538 and resistor 537; but capacitor 536 will continue to apply a logic "0" to the lower input of that AND gate.

After a delay of less than one (1) second, the "1" at the upper terminal of resistor 537 will cause capacitor 536 to charge to a "1". Thereupon, AND gate 538 will have a "1" at both inputs, and hence will apply a "1" to each of the R inputs of flip-flops 500, 504, 508, 512, 516, 520, 524 and 528 via OR gate 540. The re-setting of those flip-flops will immediately enable the slug rejector to test further coins and to respond to a single null on one of the conductors SQ, SQQ, SQD and SQN to again set one of the flip-flops 500, 508, 516 and 524. Significantly, however, the re-setting of flip-flops 500, 504, 508, 512, 516, 520, 524 and 528 will not change the outputs of any of flip-flops 546, 548, 500 and 552. Consequently, the "1" of the Q output of flip-flop 546 will continue to appear at the upper input of AND gate 562. In this way, the electronic slug rejector can be readied for the testing of further coins while it is still completing the testing of a previously-inserted coin.

At the time the OR gate 556 applied a "1" to the upper input of AND gate 558, it also started timer 554. That timer will start a timing period which is less than one (1) second, but which is slightly longer than the time which a coin requires to roll from a position adjacent coil 204 to a position adjacent coil 206; and a "0" will appear at the output of that timer until that timing period "times out". Consequently, the mere starting of that timer will not re-set any of the flip-flops 546, 548, 550 and 552.

The dollar will roll to the lower end of runway 164, and then will fall downwardly onto the arcuate guide 168. As that dollar then rolls past the continuation 170 of that guide, it will fall downwardly past coil 206 to the coin director 28. The resulting damping of the output waveform of that coil and of capacitor 404 will cause chip 406 to develop a signal; and amplifier 414 will apply a resulting amplified signal, via conductor 416 and pin 23 of integrated circuit 348, to the lower inputs of AND gates 562, 564, 566 and 568 and also to the R input of flip-flop 560. The resulting application of a "1" to the lower input of AND gate 562 will coact with the "1"—which flip-flop 546 applied to the upper input of that AND gate when it was set and which it will still be applying to that upper input—to provide two inputs to AND gate 562. An output will then appear on conductor 114 which will indicate that a coin has been inserted, has been tested, has been determined to be an authentic dollar coin, and has been delivered to the coin director 28.

The "1" at the R input of flip-flop 560 will re-set that flip-flop, thereby permitting the returning spring of solenoid 188 to return the accept-reject gate 184 to the reject position. The timer 554 will then "time out"; and the resulting "1" at the R inputs of flip-flops 546, 548, 550 and 552 will re-set flip-flop 546, and will make certain that the other flip-flops are in their re-set conditions. The coin director will direct the dollar to a passageway where it will be held in escrow, all as disclosed by Raymond A. Johnson application Ser. No. 36,335 for Coin Handling Device which was filed May 4, 1979. At this time, the electronic slug rejector will be in its "standby" condition where it will await the insertion of a further coin.

If a quarter is inserted, it will roll past coils 202, 200, 204, and 206. The operation of coils 202, 204 and 206 and of their circuits will be identical to that when the dollar was inserted. The operation of coil 200 will be similar to that when the dollar was inserted; but the bridge which includes adjustable resistors 238 and 240 and capacitor 242 will provide an output. Hence, differential amplifier 254 and comparator 262 will apply a signal, via conductor V30Q, to block 582; and that block will apply a signal, via conductor SJQ, to block 594—with consequent application of a signal to conductor SQQ. Flip-flop 508, AND gate 514, and flip-flop 548 will supply the requisite accept signals to OR gate 556 and to AND gate 564. The consequent application of a signal to pin 2 of Port 1 of the microprocessor of said Shah et al Control Device application Ser. No. 137,524 will represent a quarter value; and the coin director 28 will direct the quarter to the quarter tube of Johnson application Ser. No. 36,335.

If a dime is inserted, it will roll past coils 202, 200, 204, and 206. The operation of coils 202, 204 and 206 and of their circuits will be identical to that when the dollar was inserted. The operation of coil 200 will be similar to that when the dollar was inserted; but the bridge which includes adjustable resistors 232 and 234 and capacitor 236 will provide an output. Hence differential amplifier 256 and comparator 268 will apply a signal, via conductor V30D, to block 584; and that block will apply a signal, via conductor SJD to block 596—with consequent application of a signal to conductor SQD. Flip-flop 516, AND gate 522 and flip-flop 550 will supply the requisite accept signals to OR gate 556 and to AND gate 566. The consequent application of a signal to pin 1 of Port 1 of the microprocessor of said Shah et al Control Device application Ser. No. 137,524 will represent a dime value; and the coin director 28 will direct the dime to the dime tube of Johnson application Ser. No. 36,335.

If a nickel is inserted, it will roll past coils 202, 200, 204, and 206. The operation of coils 202, 204 and 206 and of their circuits will be identical to that when the dollar was inserted. The operation of coil 200 will be similar to that when the dollar was inserted; but the bridge which includes adjustable resistors 226 and 228 and capacitor 230 will provide an output. Hence differential amplifier 258 and comparator 270 will apply a signal, via conductor V30N, to block 586; and that block will apply a signal, via conductor SJN to block 598—with consequent application of a signal to conductor SQN. Flip-flop 524, AND gate 530 and flip-flop 552 will supply the requisite accept signals to OR gate 556 and to AND gate 568. The consequent application of a signal to pin 0 of Port 1 of the microprocessor of said Shah et al Control Device application Ser. No. 137,524 will represent a nickel value; and the coin director 28 will direct the nickel to the nickel tube of Johnson application Ser. No. 36,335.

If a non-cupreous slug is introduced, it will cause coil 202 and capacitor 390, chip 392 and amplifier 400 to apply a "1" to conductor 402; and flip-flop 532 will respond to that "1" to start timer 542. That slug will be unable to cause any of the four Wien bridges to provide a single null—such a slug either being unable to cause any of those bridges to provide even one null or causing one or more of those bridges to provide two or more nulls. If that slug does not cause any of the four Wien bridges to provide even one null, no effective change will occur in the signals on any of conductors V30, V30Q, V30D and V30N. Consequently, no pulse will appear on any of the conductors SJ, SJQ, SJD and SJN or on any of the conductors SQ, SQQ, SQD or SQN; and hence none of the flip-flops 500, 508, 516 and 526 will be "set", and none of the AND gates 506, 514, 522 and 530 will have a "1" at the middle input thereof.

Subsequently, when that slug rolls past coil 204, that coil, capacitor 286, chip 284 and amplifier 298 will coact to apply a "1" to conductor 289. The consequent "1" at the lower inputs of AND gates 506, 514, 522 and 530 will be ineffectual, because none of those AND gates has a "1" at the middle input thereof. The application of the "1" to the lower input of AND gate 558 by conductor 299 also will be ineffectual because the upper input of that AND gate did not, and will not, receive a "1" from OR gate 556. This means that AND gate 558 will not "set" flip-flop 560; and the continued "0" at the Q output of that flip-flop will keep transistor 602 non-conductive and solenoid 188 de-energized.

The "1" which the $\overline{Q}$ output of flip-flop 532 applied to the upper input of AND gate 538, as that flip-flop was reset by the "1" on conductor 299, also was applied to resistor 537. After a short delay, the capacitor 536 will change to a logic "1"; and the resulting "1"'s at the inputs of AND gate 538 will cause that gate to apply a "1" to OR gate 540. The resulting "1" at the output of that OR gate will be applied to the re-set inputs of all of flip-flops 500, 504, 508, 512, 516, 520, 524 and 528. Those flip-flops would not have been "set"; because the slug was unable to cause a signal to be developed on any of the conductors SQ, SQQ, SQD and SQN. As a result the "1" from OR gate 540 will not be effective at this time, because all of those flip-flops are in their reset states.

It thus should be apparent that where a slug is unable to cause any of the four Wien bridges to develop a single null, the electronic slug rejector will leave the accept/reject gate 184 in the reject position, and will not develop an output on any of the conductors 108, 110, 112 and 114. A signal will be developed on conductor 402 as the slug rolls past coil 202, and that signal will "set" flip-flop 532—with consequent starting of timer 542. A further signal will be developed on conductor 299 as the slug rolls past coil 204, and that signal will re-set flip-flop 532, and thereby will effect the subsequent application of a re-set signal to the R inputs of flip-flops 500, 504, 508, 512, 516, 520, 524 and 528. However, the signal on conductor 299 will not be able to effect the acceptance of the slug, and will not be able to effect the development of a signal on any of the conductors 108, 110, 112 or 114.

If, however, the non-cupreous slug had caused one or more of the four Wien bridges to develop two or more nulls, signals would be developed on one or more of the conductors V30, V30Q, V30D and V30N, on one or more of the conductors SJ, SJQ, SJD and SJN, and on one or more of the conductors SQ, SQQ, SQD or SQN. If it is assumed that two nulls had been developed on conductor V30Q, on conductor SJQ, and on conductor SQQ, the "1" which corresponded to the first null would have been applied to the upper input of AND gate 510 and to the clock input of flip-flop 508, but that flip-flop would not have provided an immediate "1" at its Q output. Instead, because that flip-flop triggers on negative edges, that "1" would not have appeared until the first "1" on conductor SQQ disappeared; and hence the application of the "1" to the lower input of AND gate 510 by that flip-flop could not have been effective at that time, because the "1" at the upper input of AND gate 510 had disappeared. However, flip-flop 508 would have continued to apply logic "1" to the lower input of AND gate 510; and, when the "1" corresponding to the second null was applied to the upper input of the AND gate 510, that AND gate applied a "1" to flip-flop 512. The resulting "0" at the $\overline{Q}$ output of that flip-flop was applied to, and maintained at, the upper input of AND gate 514. As a result, when the slug subsequently rolled past coil 204, and that coil coacted with the capacitor 286, chip 284 and amplifier 298 to apply a "1" to conductor 299, AND gate 514 could not respond to that "1"—because of the continuing "0" at the upper input of that gate. As a result, none of the flip-flops 546, 548, 550 and 552 will receive a setting input and none of those flip-flops will develop a "1" at its Q output; and hence the accept/reject gate 184 will remain in the reject position and no credit-establishing signal will be developed on any of the conductors 108, 110, 112 or 114. The "1" on conductor 402 would have started the timer 542; and the "1" on conductor 299 would have been applied to one input on each of the AND gates 506, 514, 522, 530 and 558. However, because all of those AND gates had a "0" at another of its inputs, none of those gates was able to develop a "1" at its output. The "1" which conductor 299 and OR gate 534 applied to the R input of flip-flop 532 caused that flip-flop to apply a "1" to the upper input of AND gate 538 and to resistor 537. The subsequent charging of capacitor 536, and the consequent application of a "1" by AND gate 538 and OR gate 540 to the R inputs of flip-flops 500, 504, 508, 512, 516, 520, 524 and 528 re-set those flip-flops. At this time, the electronic slug rejector was again in its "standby" position ready to test further inserted coins.

If a slug were to cause more than two nulls to be developed on conductors V30Q, SJQ and SQQ, the first null would "set" flip-flop 508 and the second null would "set" flip-flop 512. The third null would not have any effect; because those flip-flops will not be re-set by the application of further signals to the CL or S inputs, respectively. As a result, the third and any additional nulls will not have any effect; and the continuing "0" at the upper input of AND gate 514 would keep that gate from developing a "1" at its output.

The hereinbefore-described sensing of coins which develop a single null, the hereinbefore-described rejecting of slugs which either provide no null or provide two or more nulls are not, per se, parts of the present invention; because they are disclosed in said U.S. and corresponding Japanese applications. Further, the structure in integrated circuit 210, in the four Wien bridges, in the integrated circuit 250, in the blocks 580, 582, 584, 586, 592, 594, 596 and 598, and the structure in FIG. 16, are not, per se, parts of the present invention. As a result, various alternate components sub-circuits and integrated circuits other than those shown could be used.

Many copper slugs will evoke the same response which non-cupreous slugs evoke. Specifically, many copper slugs will either be unable to cause any of the four Wien bridges to develop a single null, or will cause one or more of those bridges to develop two or more nulls. In either event, the circuitry of the electronic slug rejector will permit the accept/reject gate 184 to remain in its reject position, and will not provide a credit-indicating signal on any of the conductors 108, 110, 112 and 114.

In responding to authentic coins, to non-cupreous slugs, and to many copper slugs by developing an output signal, coil 204, capacitor 286, chip 284 and amplifier 298 coact to perform the same function which is performed by the second light-sensitive element of the electronic slug rejector of said U.S. and corresponding Japanese applications. Specifically, that coil, capacitor, chip and amplifier sense the presence of a metallic object to develop an output signal. However, if a copper slug was able to cause one or more of the four Wien bridges to develop a single null on the conductors V30D, SJD and SQD, coil 204, capacitor 286, chip 284 and amplifier 298 would perform a very important second function.

The coil 202, the capacitor 390, the chip 392 and the amplifier 400 would respond to the rolling of that copper slug past that coil to develop a "1" on conductor 402; and that "1" would "set" flip-flop 532 and thereby start the timer 542. The coil 200, the resistor 224, the adjustable resistors 232 and 234, and the capacitor 236 would respond to the rolling of that copper slug past that coil to develop a signal which would be processed by differential amplifier 256, comparator 268, block 584 and block 596 to supply a "1" to flip-flop 516 and to the upper input of AND gate 518. The resulting "1" at the Q output of that flip-flop would coact with the "1" at the $\overline{Q}$ output of flip-flop 520 to provide two of the three "1"'s which AND gate 522 needs to enable it to set flip-flop 550.

When that copper slug rolls past the coil 204, that coil and its resonating capacitor 286 will not develop a response which will enable the chip 284 to supply an output to amplifier 298. Consequently, conductor 299 will continue to apply a "0" to the upper input of NOR gate 534 and to the lower inputs of all of AND gates 506, 514, 522, 530 and 558. As a result, no signal will appear at the output of any of those AND gates, and none of the flip-flops 546, 548, 550, 552 and 560 will be set. Consequently, the accept/reject gate 184 will remain in the reject position, and no signal will be developed on any of the conductors 108, 110, 112 and 114. The copper slug will be deflected away from coil 206 by the offset 185 on the accept/reject gate 184; and hence no signal will be developed on conductor 416. Also, that slug will be directed to the reject outlet 175.

Prior to the time that slug reaches that outlet, the timer 542 will "time out"; and it will apply a "1" to OR gate 534—with consequent re-setting of flip-flop 532. The resulting logic "1" at the $\overline{Q}$ output of that flip-flop will be applied to the upper input of AND gate 538 and to the upper terminal of resistor 537. After a short delay, the capacitor 536 will charge to a logic "1"; and hence AND gate 538 will apply a "1" to OR gate 540, and thence to the R inputs of all of flip-flops 500, 504, 508, 512, 516, 520, 524 and 528. At such time, the slug rejector will be in its "standby" condition—ready for the insertion of further coins.

It will be noted that the coil 204 performs important functions. Specifically, when authentic coins are inserted, it will sense the presence of those coins and will, via conductor 299, apply a "1" to the lower inputs of each of the AND gates 506, 514, 522 and 530, and also will, via OR gate 534, re-set flip-flop 532. The "1" at the lower inputs of those AND gates performs the function of establishing the passage of a metal object far enough past coil 200 to be sensed by coil 204; and the re-setting of flip-flop 532 performs the function of stopping the timer 542. When a copper slug is inserted, the coil 204 performs a very important function, namely, permitting that slug to roll past it without permitting any change in the logic state on conductor 294. The requirement that the coil 204 be able to sense and respond to all authentic coins to provide a "1" on conductor 299 is a basic requirement. Added to that requirement is the critical requirement that it permit a copper slug to move past it without developing a "1" on that conductor—even though that slug has characteristics which enable that slug to interact with coil 200 to produce the same kind of response which an authentic coin produces.

It will be noted that slugs, other than a copper slug, will cause coil 204 to change the logic state on conductor 299. As a result, a "1" will be applied to the lower inputs of AND gates 506, 514, 522, 530 and 558. However, because those slugs had been unable to coact with coil 200 and one or more of the Wien bridges to cause a signal to appear on conductors SQ, SQQ, SQD or SQN, none of the AND gates 506, 514, 522 and 530 would have the requisite three logic "1"'s at the inputs thereof. The interaction of coil 204 with a copper slug must be significantly different than the reaction which that coil has with an authentic coin or with other slugs; because a copper slug might, occasionally, interact with coil 200 and one of the Wien bridges to cause a "1" to appear on one of the SQ, SQQ, SQD and SQN conductors—thereby effecting the application of logic "1"'s to the middle inputs of AND gates 506, 514, 522 and 530. However, by resonating at a high frequency, coil 204 is able to respond to the passage of a copper slug in such a totally-different manner than it responds to an authentic coin or an ordinary slug, that no signal will be developed on conductor 299 when that copper slug passes that coil. Consequently, even if one of the AND gates 506, 514, 522 and 530 were to have a logic 37 1" applied to its upper inputs, that gate would not receive a "1" at its lower input; and hence no signal would be developed on any of conductors 114, 364, 366, 368 and 370. Consequently, no credit would be supplied to the microprocessor in said Shah et al CONTROL DEVICE application, Ser. No. 137,524 and the accept/reject gate 184 would be left in its reject position.

In the event a customer inserted one or more authentic coins, the microprocessor of the Shah et al CONTROL DEVICE application would respond to those coins to establish a credit corresponding to the values of those coins. If the customer then decided to retrieve his money, he could press the cancel sale button of the vending machine; and the corresponding downward movement of cancel sale lever 160 of FIG. 1 would move the metal plate 161 away from coil 208. Normally, that plate dampens the output waveform of that coil, and hence causes integrated circuit 420 and amplifier 428 to maintain a logic "1" on conductor 430. As a result, the inverter 544 of FIG. 16 normally maintains a "0" at the lower input of OR gate 540.

As the metal plate 161 is moved away from the field of coil 208, that coil and capacitor 418 will coact with integrated circuit 420 and amplifier 428 to remove the logic "1" on conductor 430. Thereupon, inverter 544 will apply a "1" to the input of OR gate 540, and hence to the R inputs of all of flip-flops 500, 504, 508, 512, 516, 520, 524 and 528. Those flip-flops will be re-set, and hence will remove any "1" which any of flip-flops 500, 508, 516 and 524 had been applying to one of the AND gates 506, 514, 522 and 530. The "0" on conductor 430 would exist as long as the customer pushed the cancel sale button; and inverter 544 would respond to that "0" to apply a continuous "1" to all of flip-flops 500, 504, 508, 512, 516, 520, 524 and 528 to keep them in their re-set condition. Consequently, even if a customer were to insert further coins, and even if those coins were able to interact with coil 200 and one of the bridges to establish a signal on conductor SQ, SQQ, SQD or SQN, that signal would not be able to set any of the flip-flops 500, 508, 516 and 524. Also, the accept/reject gate 184 would remain in reject position; and hence, those further-inserted coins would be returned to the customer. In this way, the customer is protected against loss of coins even if he inserted them while pressing on the cancel sale button. A branch of conductor 430, which is shown in the lower right-hand portion of FIG. 13, will apply a logic "0" to pin 6 of Port 0 of the microprocessor of the Shah et al CONTROL DEVICE application. That "0" will indicate to that microprocessor that it must dispense to the customer coinage equal to the value of the coins which had been inserted and credited.

It will be noted that conductor 430 can receive a signal from pin 6 of Port 0 of that microprocessor at any time and supply it to the electronic slug rejector to keep it from accepting coins.

This is desirable, whenever a vend cycle has been initiated, and throughout the time that vend cycle is being completed. At such time, the inverter 544 will act through OR gate 540 to re-set all of the flip-flops 500, 504, 508, 512, 516, 520, 524 and 528. As indicated hereinbefore, the re-setting of flip-flops 500, 508, 516 and 524 will prevent the acceptance of coins, by leaving the accept/reject gate 184 in its reject position.

The coil 202 and the capacitor 390 constitute a parallel resonant circuit. Similarly, coil 204 and capacitor 286, coil 206 and capacitor 404, and coil 208 and capacitor 418 constitute further parallel resonant circuits. The resistances of such circuits increase very sharply at resonance, and the chips 392, 284, 406 and 420 compare the effective resistances of those parallel resonant circuits at resonance with the sum of the resistances of the series-connected resistors at pins 2 and 4 thereof. Specifically, the output at pin 6 of each of the chips 284, 392, 406 and 420 normally is a "0", but that output will change to a logic "1" as soon as the resistance of the parallel resonant circuit equals the resistance of the series-connected fixed and adjustable resistors 290 and 292, 394 and 396, 410 and 412, and 422 and 424. The accuracy and ready adjustability of the chips 294, 392, 406 and 420 make them very useful. However, if desired, other chips could be used. One preferred chip which could be used to replace the chips 392, 406 and 420 is a Synertek Switch Chip C10522.

When an authentic coin is inserted, the value of the resistance of the parallel resonant circuit which includes coil 204 and capacitor 286 will exceed the sum of the resistances of fixed resistor 290 and adjustable resistor 292. However, when a copper slug passes that coil, the resistance of the parallel resonant circuit will not rise to the point where it matches the sum of the resistances of resistors 290 and 292. Consequently, the "0" logic state of pin 6 will not change, and hence resistor 294 will remain non-conductive and thereby cause transistor 296 to maintain a logic "0" on conductor 299. Although the Nucleonics Product Company NPC31BP chip is preferred for the chip 284, another chip could be used.

The numeral 650 denotes a chip which preferably is identical to the chip 250. That chip is intended to process signals which will be supplied by the coil 200 and three Wien bridges which correspond to the bridges that include adjustable resistors 226 and 228 and capacitor 230, adjustable resistors 232 and 234 and capacitor 236, and adjustable resistors 230 and 240 and capacitor 242. That chip will respond to signals which are developed as Canadian nickels, Canadian dimes, and Canadian quarters are inserted and are sensed by the coil 200. Because Canada does not have a dollar coin, only three Wien bridges are used.

Canadian coins are largely nickel in content, and hence respond differently to magnetic fields than do U.S. coins. By equipping the electronic slug rejector with the chip 650 as well as with the chip 250, that electronic slug rejector can be used in those areas of the United States and Canada where coinage of both countries is in common circulation. However, in those areas of the United States where Canadian coinage is seldom encountered, the chip 650 would not be included. Also, in those parts of Canada where U.S. coinage is seldom encountered, the chip 250 would be omitted. The funtion and response of chip 650 to the insertion of Canadian nickels, Canadian dimes and Canadian quarters will be essentially the same as the funtion and response of chip 250 to the insertion of U.S. nickels, U.S. dimes and U.S. quarters.

The particular coils that are used will affect the amount of resistance which is needed in the legs of the bridges to enable those bridges to respond to authentic coins. However, the values of resistance are easily determined. Because Canadian coins are made of magnetizable material, such as nickel, their movement past the coil 200 can develop low frequency signals on the inputs to the pins 7, 2 and 11 of chip 650. Capacitors 639, 633 and 627 are provided, respectively, to the inputs to the pins 7, 2 and 11 of the chip 650 to attenuate any low frequency signals produced by Canadian coins moving past the coil 200.

Because the resistors 226, 228, 232, 234, 238, 240, 244 and 246 are readily-adjustable resistors, the effective values of those resistors are readily established. In establishing the values to which production-line adjustable resistors should be set, a coin of the desired denomination will be positioned immediately adjacent the coil 200; and then an oscilloscope will be used to determine the damping effect of that coin. By adjusting the values of the adjustable resistors of the leg of the bridge corresponding to that coin, the desired values of resistance in the two adjustable resistors can be detemined. Before establishing the values to be used in setting the adjustable resistors on a production line, a dynamic test should be made by permitting a coin of the desired denomination to roll along the runway 164 while an oscilloscope is used to sense the dynamic damping pattern. Once the values have been established for all of the adjustable resistors of all of the bridges, those values can be supplied to the test group of a production line, and Ohmic tests of the setting of those adjustable resistors will permit precise and simple settings of those adjustale resistors.

The coil 204 and the capacitor 286 provide an additional function when authentic coins are being sensed. Specifically, that coil and capacitor coact with the chip 284 to cause the signal, which is initiated as that coil senses an authentic coin, to terminate almost simultaneously with the initiation of a very narrow pulse at the output of the Wien bridge which identified that authentic coin. That very narrow pulse has a width in the order of microseconds; but that pulse is long enough to coact with the signal from chip 284 to provide an anding function that can supply a logic "0" to conductor 430. Thereupon, the flip-flops 500, 508, 516 and 524 would be re-set by a "1" from inverter 544 and the consequent "1" from OR gate 540—with consequent rejection of that authentic coin by leaving the accept-/reject gate 184 in reject position. In this direct and simple manner, rejection of any desired denomination of authentic coin can be effected while permitting all other authentic coins to be accepted.

It will be noted that the coil 204 and capacitor 286 make it possible to utilize an analog technique rather than a digital technique in detecting and rejecting copper slugs. The use of an analog technique is desirable; because it minimizes the complexity and cost of the circuitry which is required to effect the detection and rejection of copper slugs. For example, an analog technique has no need of a frequency detector or a counter—both of which would be required in a digital technique.

Whereas the drawing and accompanying description have shown and described one embodiment of the present invention, it should be apparent to those skilled in the art that various changes may be made in the form of the invention without affecting the scope thereof.

What we claim is:

1. An electronic slug rejector which has a passageway through which slugs and authentic coins can move, an authenticity-determining magnetic coil that is adjacent said passageway and that is part of a circuit which establishes a magnetic field of a predetermined frequency that extends into said passageway, a detector which senses the effect that an authentic coin, which moves through said passageway past said authenticity-determining magnetic coil, has on said magnetic field to determine the acceptability of said authentic coin and the non-acceptability of some slugs, a second magnetic coil that is adjacent said passageway and that is part of a second circuit which establishes a second magnetic field of a second predetermined frequency that extends into said passageway, and a second detector which senses the effect that a copper slug, which moves through said passageway past said second magnetic coil, has on said second magnetic field to determine the non-acceptability of said copper slug, said second predetermined frequency being substantially different from the first said predetermined frequency, said second predetermined frequency being high enough so said second magnetic field is damped to a lesser extent when a copper slug moves through said passageway past said second magnetic coil than said second magnetic field is damped when an authentic coin moves through said passageway past said second magnetic coil, whereby said second circuit and said second detector are able, by reason of the lesser damping when a copper slug moves through said passageway past said second magnetic coil, to determine the non-acceptability of some copper slugs whose non-acceptability is not determinable by the first said circuit and the first said detector.

2. An electronic slug rejector as claimed in claim 1 wherein said second detector is an analog device.

3. An electronic slug rejector as claimed in claim 1 wherein the first said magnetic coil is disposed adjacent, but wholly at one side of, said passageway for coins, wherein said second magnetic coil is disposed adjacent, but wholly at one side of, said passageway for coins, and wherein coins moving through said passageway for coins will pass through the first said magnetic field before they pass through said second magnetic field.

4. An electronic slug rejector as claimed in claim 1 wherein said second predetermined frequency is at least as high as eight hundred thousand Hertz (800,000 Hz).

5. An electronic slug rejector as claimed in claim 1 wherein said second detector can sense the effect that an authentic coin has on said second magnetic field to determine the presence of said authentic coin, and wherein said effect is a perceptible damping of said second magnetic field.

6. An electronic slug rejector as claimed in claim 1 wherein said second detector can sense the effect that an authentic coin has on said second magnetic field to determine the presence of said authentic coin, and wherein said second detector does not develop a usable signal whenever a copper slug interacts with said second magnetic field but does develop a usable signal whenever an authentic coin interacts with said second magnetic field.

7. An electronic slug rejector as claimed in claim 1 wherein a signal is developed by said second detector as said authentic coin interacts with said second magnetic field but no usable signal is developed by said second detector as said copper slug interacts with said second magnetic field, and wherein an accept/reject gate can be moved to accept position if said second detector develops a signal but can not move to accept position if said second detector does not develop a signal, whereby said second magnetic coil and said second magnetic field perform the dual function of sensing the presence of an authentic coin to effect acceptance of said authentic coin and of effecting the rejection of a copper slug by leaving said accept/reject gate in reject position.

8. An electronic slug rejector which has a passageway through which slugs and authentic coins can move, an authenticity-determining magnetic coil that is adjacent said passageway and that is part of a circuit which establishes a magnetic field of a predetermined frequency that extends into said passageway, a detector which senses the effect that an authentic coin, which moves through said passageway past said authenticity-determining magnetic coil, has on said magnetic field to determine the acceptability of said authentic coin and the non-acceptability of some slugs, a second magnetic coil that is adjacent said passageway and that is part of a second circuit which establishes a second magnetic field of a second predetermined frequency that extends into said passageway, a second detector which senses the effect that a copper slug, which moves through said passageway past said second magnetic coil, has on said second magnetic field to determine the non-acceptability of said copper slug, said second predetermined frequency being substantially different from the first said predetermined frequency, said second predetermined frequency being high enough so said second magnetic field is damped to a lesser extent when a copper slug moves through said passageway past said second magnetic coil than said second magnetic field is damped when an authentic coin moves through said passageway past said second magnetic coil, whereby said second circuit and said second detector are able, by reason of the lesser damping when a copper slug moves through said passageway past said second magnetic coil, to determine the non-acceptability of some copper slugs whose non-acceptability is not determinable by the first said circuit and the first said detector, a further magnetic coil that establishes a further magnetic field of a desired frequency, a further detector which senses the effect that said authentic coin has on said further magnetic field to determine the presence of said authentic coin, wherein a signal developed by said further detector in response to the sensing of said authentic coin adjacent said further magnetic coil initiates a timing function, wherein a signal is developed by said second detector as said authentic coin interacts with said second magnetic field but no usable signal is developed by said second detector as said copper slug interacts with said second magnetic field, and an accept/reject gate that will be moved to accept position if said authentic coin passes from said further magnetic field to said second magnetic field and causes said second detector to develop said signal before said timing function is completed, said accept/reject gate remaining in reject position if said copper slug passes from said further magnetic field to said second magnetic field and said second detector does not develop a usable signal before said timing function is completed.

9. A detecting system which can distinguish between non-cupreous, non-magnetic coins and a copper slug and which comprises a magnetic coil that is mounted adjacent a location where non-cupreous, non-magnetic coins and a copper slug could appear, a capacitor which is connected to said magnetic coil to coact with said magnetic coil to form a resonant circuit that resonates at a frequency at least as high as eight hundred thousand Hertz (800,000 Hz), an oscillator which supplies a waveform to said resonant circuit to permit said resonant circuit to resonate at a frequency at least as high as eight hundred thousand Hertz (800,000 Hz), said resonant circuit responding to a copper slug in said location to experience a damping of the output waveform thereof which is less than, and which is distinctly different than, the damping of said output waveform whenever a non-cupreous, non-magnetic coin is in said location, and means to distinguish between a copper slug and a non-cupreous, non-magnetic coin by a determination of the extent of damping of said output waveform of said resonant circuit.

10. A detecting system as claimed in claim 9 wherein said means is an analog device, and wherein said means will not provide a useful signal when said copper slug is in said location.

11. A detecting system as claimed in claim 9 wherein said means will not provide a useful signal when said copper slug is in said location, and wherein said means will produce a useful signal when said non-cupreous, non-magnetic coin is in said location.

12. An electronic slug rejector which has an authenticity-determining coil that is intended to effect the rejection of substantially all slugs and that is intended to effect the acceptance of substantially all authentic coins, a detecting coil which is positioned beyond said authenticity-determining coil, whereby coins and slugs move past said authenticity-determining coil and then move past said detecting coil, an oscillator which causes said detecting coil to develop a magnetic field having a frequency high enough so said magnetic field is damped to a lesser extent by a copper slug than it can be damped by a non-cupreous coin, an accept-reject gate which is disposed beyond said detecting coil and which is disposable in accept position to effect the acceptance of authentic coins and which is disposable in reject position to effect the rejection of slugs, means to effect movement of said accept/reject gate between accept and reject positions, and a circuit which can cause said means to dispose said accept/reject gate in accept position only if said authenticity-determining coil provides a signal indicating that an authentic coin has moved past it and if said detecting coil provides a signal indicating that a non-cupreous coin has moved past it, said circuit causing said means to leave said accept/reject gate in reject position in the event said circuit does not receive a signal from both said authenticity-determining coil and said detecting coil, and said detecting coil not providing a signal when a copper slug moves past it and thereby effecting the rejection of said copper slug by said accept/reject gate.

13. An electronic slug rejector which has an authenticity-determining coil that is intended to effect the rejection of substantially all slugs and that is intended to effect the acceptance of substantially all authentic coins, a detecting coil, and an oscillator which enables said detecting coil to develop a magnetic field having a predetermined frequency which is high enough so said magnetic field is damped to a lesser extent by a copper slug than it can be damped by an authentic coin, said detecting coil providing a usable signal when an authentic coin moves past it, said detecting coil not providing a usable signal when a copper slug moves past it.

14. An electronic slug rejector as claimed in claim 13 wherein said detecting coil is located beyond said authenticity-determining coil, whereby said authentic coin and said copper slug must move past said authenticity-determining coil to reach said detecting coil.

15. The method of distinguishing between the presence of a non-cupreous, non-magnetic coin and the presence of a copper slug which comprises developing a magnetic field which resonates at a frequency which is high enough so a copper slug provides less damping of the output waveform than the damping of that output waveform which a non-cupreous, non-magnetic coin will provide, directing non-cupreous, non-magnetic coins and said copper slug to said magnetic field, using the larger damping of said output waveform, when a non-cupreous, non-magnetic coin interacts with said magnetic field, to cause a circuit to provide a given response, and using the smaller damping of said output waveform, when a copper slug interacts with said magnetic field, to cause said circuit not to provide said given response.

16. The method of detecting a copper slug as claimed in claim 15 wherein said frequency is at least as high as eight hundred thousand Hertz (800,000 Hz).

17. A detecting system which can distinguish between non-cupreous, non-magnetic coins and a copper slug and which comprises a magnetic coil that is mounted adjacent a location where non-cupreous, non-magnetic coins and a copper slug could appear, a capacitor which is connected to said magnetic coil to coact with said magnetic coil to form a resonant circuit that provides a magnetic field having a frequency high enough so said magnetic field is damped to a lesser extent by a copper slug than it can be damped by non-cupreous, non-magnetic coins, an oscillator which supplies a waveform to said resonant circuit to permit said resonant circuit to develop said magnetic field having said frequency, said resonant circuit responding to a copper slug in said location to experience a damping of said magnetic field which is less than, and which is distinctly different than, the damping of said magnetic field whenever a non-cupreous, non-magnetic coin is in said location, and means to distinguish between a copper slug and a non-cupreous, non-magnetic coin by a determination of the extent of damping of said magnetic field.

* * * * *